US008032246B2

(12) United States Patent
Michal, III et al.

(10) Patent No.: US 8,032,246 B2
(45) Date of Patent: Oct. 4, 2011

(54) WINDING METHOD FOR UNIFORM PROPERTIES

(75) Inventors: Neal Jay Michal, III, Cumming, GA (US); Balaji Kovil Kandadai, Cumming, GA (US); Robert James Coxe, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 266 days.

(21) Appl. No.: 11/825,129

(22) Filed: Jul. 3, 2007

(65) Prior Publication Data

US 2008/0185473 A1 Aug. 7, 2008

Related U.S. Application Data

(60) Provisional application No. 60/899,315, filed on Feb. 2, 2007.

(51) Int. Cl.

| | |
|---|---|
| ***G06F 19/00*** | (2006.01) |
| ***B65H 23/00*** | (2006.01) |
| ***B65H 51/015*** | (2006.01) |
| ***B65H 55/00*** | (2006.01) |

(52) U.S. Cl. ..... 700/126; 242/410; 242/159

(58) Field of Classification Search ..... 700/126; 242/410, 159

See application file for complete search history.

(56) References Cited

U.S. PATENT DOCUMENTS

| | | | | |
|---|---|---|---|---|
| 4,358,067 A | * | 11/1982 | Kanda et al. | 242/413.2 |
| 5,308,010 A | * | 5/1994 | Hakiel | 242/534 |
| 5,402,353 A | | 3/1995 | Laplante et al. | |
| 5,556,052 A | | 9/1996 | Knaus | |
| 5,685,955 A | | 11/1997 | Leigraf et al. | |
| 5,709,331 A | | 1/1998 | Lam et al. | |
| 5,727,749 A | * | 3/1998 | Pensavecchia et al. | 242/538.3 |
| 5,781,440 A | | 7/1998 | Adamy | |
| 5,953,230 A | * | 9/1999 | Moore | 700/122 |
| 6,089,496 A | | 7/2000 | Dorfel | |

(Continued)

FOREIGN PATENT DOCUMENTS

GB 2117935 A 10/1983

(Continued)

OTHER PUBLICATIONS

Zbigniew Hakiel, Nonlinear Model for Wound Roll Stresses, (TAPPI Journal, vol. 70(5), pp. 113-117, 1987).

*Primary Examiner* — Albert Decady
*Assistant Examiner* — Jason Lin
(74) *Attorney, Agent, or Firm* — Dority & Manning, P.A.

(57) ABSTRACT

A winding procedure has been developed that results in substantially uniform material properties from the outside diameter to the core of a wound roll of elastomeric webs produced by vertical film lamination (VFL) or stretch bond lamination (SBL) or as registered film. The web material is wound onto the roll in accordance with a wound on tension (WOT) profile that varies with the diameter of the wound web in a manner that was calculated using WOT transposition that is based on a modified version of Hakiel's nonlinear model for wound roll stresses. A constant WOT winding profile is corrected to obtain a compensated WOT winding profile that can be employed to wind the material into a roll that exhibits properties (including MD stress in the web) that are substantially uniform thru-roll. This resulting controlled winding technique has immediate application for webs that are converted for child care products, adult care products, and infant care products.

22 Claims, 20 Drawing Sheets

U.S. PATENT DOCUMENTS 6,200,422 B1 * 3/2001 Shakespeare et al. ..... 162/198
6,363,297 B1 3/2002 Wienholt et al.
6,447,278 B1 * 9/2002 Arruda ..... 425/72.1
6,604,703 B2 8/2003 Beisswanger et al.
6,629,659 B1 10/2003 Innala et al.
6,778,936 B2 8/2004 Johansson
6,828,743 B2 12/2004 Debuf
6,840,475 B1 1/2005 Mucke et al.
6,845,282 B2 1/2005 Franz
6,873,879 B2 3/2005 Bush et al.
6,923,400 B2 8/2005 Mausser et al.
6,966,474 B2 11/2005 Berg et al.
6,966,762 B1 11/2005 Maggio et al.
6,966,971 B1 11/2005 Sellars et al.
6,985,789 B2 1/2006 Carlson et al.
6,991,144 B2 1/2006 Franz et al.
7,000,864 B2 2/2006 McNeil et al.
7,070,141 B2 7/2006 Paanasalo
7,080,803 B2 7/2006 Rösch et al.
7,092,781 B2 8/2006 Franz et al.
7,118,062 B2 10/2006 Vaidyanathan et al.
7,121,496 B2 10/2006 Jackson
7,162,932 B2 1/2007 Jorkama
7,187,995 B2 3/2007 Floeder et al.
2002/0117572 A1 * 8/2002 Nechitailo et al. ..... 242/410
2003/0226928 A1 * 12/2003 McNeil et al. ..... 242/413.2
2004/0123938 A1 * 7/2004 Neculescu et al. ..... 156/160
2004/0149846 A1 * 8/2004 Zwettler et al. ..... 242/334.5
2004/0154391 A1 * 8/2004 Paanasalo ..... 73/159
2005/0156078 A1 7/2005 Ragard et al.
2005/0167460 A1 * 8/2005 Franz et al. ..... 226/24
2005/0273193 A1 12/2005 Lindsey
2006/0009873 A1 * 1/2006 Scott et al. ..... 700/144
2006/0011766 A1 * 1/2006 Koutonen et al. ..... 242/413.2
2006/0016359 A1 1/2006 Ford
2007/0045464 A1 3/2007 McNeil et al.
2008/0155765 A1 * 7/2008 Janssen et al. ..... 8/444

FOREIGN PATENT DOCUMENTS

WO WO 99/42392 8/1999
WO WO 02/102963 A2 12/2002

* cited by examiner

| VFL - VFRA | | | | | | | | |
|---|---|---|---|---|---|---|---|---|
| YARDAGE | DIAMETER | MD STRAIN (CONSTANT WOT) | STRAIN @ YIELD (CONSTANT WOT) | YARDAGE | DIAMETER [in] | MD STRAIN (CONTROLLED WOT) | STRAIN @ YIELD (CONTROLLED WOT) | % IMPROVEMENT |
| 2224.05 | 59.5 | 22.5 | 130.33 | 2423.88 | 59.5 | 18.75 | 131.40 | |
| 2075.96 | 57.5 | 21.875 | 139.93 | 2260.42 | 57.5 | 18.125 | 131.00 | |
| 1932.88 | 55.5 | 22.5 | 118.59 | 2102.58 | 55.5 | 18.125 | 130.59 | |
| 1790.15 | 53.5 | 20 | 130.57 | 1950.35 | 53.5 | 16.875 | 127.19 | |
| 1657.28 | 51.5 | 20 | 134.21 | 1803.73 | 51.5 | 17.5 | 132.35 | |
| 1406.61 | 47.5 | 16.875 | 138.60 | 1531.48 | 47.5 | 18.4375 | 133.90 | |
| 962.03 | 39.5 | 18.75 | 143.64 | 1045.32 | 39.5 | 17.5 | 119.96 | |
| 599.15 | 31.5 | 15.9375 | 135.68 | 651.72 | 31.5 | 18.75 | 125.80 | 64.1 |
| 317.95 | 23.5 | 15 | 138.74 | 344.46 | 23.5 | 17.8125 | 131.57 | 49.1 |
| 118.46 | 15.5 | 15.625 | 152.95 | 128.36 | 15.5 | 19.375 | 132.24 | |
| 80.46 | 13.5 | 15.9375 | 157.95 | 87.85 | 13.5 | 20 | 133.03 | |
| 48.84 | 11.5 | 15 | 138.66 | 52.95 | 11.5 | 19.375 | 119.69 | |
| 22.24 | 9.5 | 16.42857143 | 139.04 | 23.67 | 9.5 | 17.1875 | 128.96 | |
| 10.45 | 8.5 | 15 | 141.98 | 11.13 | 8.5 | 16.25 | 130.62 | |
| | %Cv | 15.5 | 6.6 | | | 5.6 | 3.4 | |

FIG. 10e

| VFL - FIDO | | | | | | | | |
|---|---|---|---|---|---|---|---|---|
| ROLL LENGTH [Yds] | DIAMETER | MD STRAIN (CONSTANT WOT) | STRAIN @ YIELD (CONSTANT WOT) | ROLL LENGTH [Yds] | DIAMETER [in] | MD STRAIN (CONTROLLED WOT) | STRAIN @ YIELD (CONTROLLED WOT) | % IMPROVEMENT |
| 2171.36 | 59.5 | 22.5 | 148.92 | 2422.37 | 59.5 | | 152.93 | |
| 2028.35 | 57.5 | 20 | 165.83 | 2264.05 | 57.5 | 19.375 | 159.93 | |
| 1885.28 | 55.5 | 18.75 | 159.70 | 2106.14 | 55.5 | 19.6875 | 159.66 | |
| 1752.02 | 53.5 | 17.5 | 165.06 | 1953.84 | 53.5 | 18.125 | 161.15 | |
| 1619.06 | 51.5 | 17.1875 | 162.37 | 1807.14 | 51.5 | 19.375 | 159.55 | |
| 1372.70 | 47.5 | 16.5625 | 165.38 | 1530.58 | 47.5 | 18.125 | 159.64 | |
| 939.55 | 39.5 | 15.9375 | 171.90 | 1048.20 | 39.5 | 17.1875 | 154.93 | |
| 583.09 | 31.5 | 14.375 | 179.70 | 651.40 | 31.5 | 17.8125 | 154.53 | |
| 309.51 | 23.5 | 14.375 | 193.09 | 346.37 | 23.5 | 17.8125 | 158.01 | 71.5 |
| 115.36 | 15.5 | 14.0625 | 176.14 | 128.32 | 15.5 | 19.0625 | 160.98 | 59.4 |
| 78.65 | 13.5 | 14.375 | 185.73 | 87.83 | 13.5 | 18.75 | 158.09 | |
| 48.08 | 11.5 | 19.0625 | 173.29 | 52.95 | 11.5 | 19.0625 | 152.22 | |
| 21.47 | 9.5 | 16.25 | 175.68 | 23.67 | 9.5 | 19.375 | 146.89 | |
| 5.41 | 8 | 16.875 | 166.64 | 5.39 | 8 | 18.75 | 160.51 | |
| | %Cv | 13.9 | 6.3 | | | 4.0 | 2.6 | |

FIG. 11e

FLOWCHART OF THE WINDING METHOD

WINDING METHOD FOR UNIFORM PROPERTIES

CROSS-REFERENCE TO RELATED APPLICATIONS

The present application hereby claims priority to pending U.S. Provisional Application Ser. No. 60/899,315, filed Feb. 2, 2007.

STATEMENT REGARDING FEDERALLY SPONSORED RESEARCH

N/A

BACKGROUND

Winding is the process of turning a flat web into a wound roll. Wound rolls are the most efficient method to store large amounts of continuous web material in a package that is convenient for material handling and shipping. The wound roll must be wound hard enough to withstand roll handling, storage conditions, clamp truck pressures, and automated material handling systems. The wound roll becomes the delivery device as the material is unwound from the roll and further processed in a manufacturing line such as in a converting process.

Although each wound roll is its own unique entity, it is a common practice in film and newspaper industries to qualify a roll as either a "hard" roll or a "soft" roll. This is done based on the "feel" or "hardness" of the wound roll. A hard roll is also commonly called a "fully compressed roll". Typically, wound rolls of tissue, newsprint, spunbond-meltblown-spunbond laminates (SMS) fall under the category of soft rolls. Wound rolls of polyester and film laminates fall under the category of fully compressed rolls, which are so-called "hard rolls." Also, wound rolls of low modulus films, film laminates, vertical film/filament laminates (VFL's) and stretch bond laminates (SBL's) fall under the "hard roll" category. A "hard roll" is produced when the machine direction (MD) modulus of the material is comparable to the radial modulus (ZD Modulus) of the material ($E_t \cong E_r$). A "soft roll" is produced when the MD modulus of the material is much greater than the radial modulus of the material ($E_t >> E_r$).

Winding continuous web materials into a wound roll results in stored stresses within the roll, and thus winding presents an accretive stress problem. For commodity grade spunbond there is very little concern about how tightly the material is wound around the roll. However, when elastomerics, delicate laminates, or high loft web materials are wound, the roll structure (hardness) results in a permanent change of material properties inside the wound roll. This change can occur during the winding process, immediately after the winding process or over a period time.

The tension in the outermost layer of a continuous web of material being wound onto a roll is known as the "wound on tension" or "WOT." This WOT parameter includes the web tension and any additional tension that may be due to nip load (nip induced tension), which depends on the type of winder. Each new layer added onto the winding roll during the winding process changes the stresses inside the wound roll.

Zbigniew Hakiel's paper ("Nonlinear model for wound roll stresses", TAPPI Journal, Vol. 70(5), pp 113-117, 1987) describes how the wound roll stresses at any diametral location within the continuous web wound into a roll can be calculated given the properties (listed under "required input values") of the roll and the material. Hakiel's paper discusses both the computational method and the flow chart for writing a computer program in any computer language, and thus a simple program can be written to predict the wound roll stresses based on what is described in Hakiel's paper. A graph of these stresses as a function of the diameter of the roll of continuous material produces a curve that exhibits a characteristic shape for both interlayer pressure (radial stress/pressure) and stresses in the machine direction (MD). The MD stress is the stress in the direction in which the web is wound onto the roll or taken off the roll and is also known as the tangential stress or the circumferential stress.

From the wound roll structure standpoint, a "soft" roll has a plateau-type radial stress profile. Addition of more web material wound on the roll does not increase the radial stresses inside these types of rolls. The only limitation to the size of the roll comes from the limitations of the winder and from the limitations of web handling, transporting units. On the other hand, a "hard" roll has a tapered radial stress profile. Addition of web material to the roll directly impacts the radial stress profile by increasing the stress inside the roll. Hence in the case of hard rolls, issues like "roll blocking" and "core crush" need to be addressed. Concern for these issues tends to restrict the size of the wound "hard" rolls.

In the case of soft rolls, the in-roll tension (also referred to as "MD stress" or "tangential stress" or "circumferential stress") is uniform throughout the roll except very near the core and at the outside diameter. In many cases the in-roll tension is close to zero and sometimes can even be negative. In hard rolls by contrast, the thru-roll MD stress and strain produces a curve that resembles a 'Nike®-Swoosh®' profile. If the wound roll were to be made of high modulus film, the swoosh profile in MD strain is not a big concern as the strains are small to begin with. As the material is being unwound, this strain, typically, is quickly recovered. Hence the winding process need not undergo any modification to accommodate this stored in-roll strain.

However this is not the case in winding low modulus films, film laminates, VFL and SBL. For example, the MD modulus of VFL material is in the range of about 5 psi to about 25 psi, which is very low. The outside diameter of a wound roll of VFL material can be in the neighborhood of 62 inches. The elastomeric filaments in the VFL material make it behave like a rubber band. As anyone who has wound a rubber band around one's finger can attest, the pressures in a wound roll of VFL material are very high, even if the material is wound onto the roll at low wound on tension (WOT).

The MD stresses in rolls of such webs of material will cause the attributes (elasticity for example) of the web material on the roll to change "thru-roll," i.e., attributes of the material wound around the core of the roll commonly will differ from the same attributes of the material wound around the outside diameter of the roll and will vary at diameters intermediate these two extreme diameters. Since the strains are very high and many materials are highly viscoelastic, the stored strains within the roll become permanent. This results in aged material properties that vary (repeatable) as a function of the roll's radius. To cope with such properties in processing the webs drawn from such hard rolls, special modifications of the process equipment (like controlled unwind) need to be in place during converting for example. The problem of coping with such properties gets complicated if printing is done on the web during converting. As the strain recovery rates are different due to different in-roll tension that the web was subjected to, the repeat length of the printed indicia may not be the same as the web material is unwound from the roll.

As noted above, webs made of elastomeric materials that are wound into rolls will experience some permanent change in the properties of the material. The elastic properties of the material wound around the core of the roll commonly will differ by more than a twenty percent variation from the elastic properties of the material wound around the outside diameter of the roll. In other words, the elastic properties "thru-roll" commonly vary by more than twenty percent. Yet the elastic properties in the machine direction (MD) are often critical to the final converting process. A change in elastic properties as the material is unwound from the roll for use in a processing line of equipment will often cause increased waste and/or downtime of the line.

Empirical studies have been conducted to develop a winding procedure that results in uniform material properties "thru-roll," i.e., from the outside diameter to the core of the wound roll. However, conducting such studies for each differently sized new roll of differently composed material is tedious, time-consuming, and in many cases cost prohibitive.

BRIEF SUMMARY OF THE DISCLOSURE

A winding procedure has been developed that results in substantially uniform material properties from the outside diameter to the core of a wound roll of elastomeric webs produced by vertical film lamination (VFL) or stretch bond lamination (SBL) or as registered film. A computer model based on Zbigniew Hakiel's paper ("Nonlinear model for wound roll stresses", TAPPI Journal, Vol. 70(5), pp 113-117, 1987) can be used to predict the thru-roll profile for elastomeric webs produced by VFL, SBL, or as registered film. Based on a concept called "WOT Transposition," a modified version of Hakiel's model can be used to correct the constant WOT winding profile to obtain a controlled (aka compensated) WOT winding profile that can be employed to wind the material into a roll that exhibits properties (including MD stress in the web) that are substantially uniform thru-roll. It is desirable to use a computer program to perform this transposition. An embodiment of such a computer program is appended hereto as Appendix A and is referred to herein as the winder computer program. This resulting controlled winding technique has immediate application for such webs that are converted for child care products, adult care products, and infant care products.

The modified Hakiel calculation model requires input values of the WOT at which each diametral section of the web is wound onto the roll, the material properties of the web, and the dimensions of the wound roll. For a steady state winding condition for winding a web to form a roll, the WOT is constant. However, when plotted as a function of the diameter of the roll, the thru-roll properties of the material that is wound onto the roll can have a unique signature that is not uniform. In particular, significant non-uniformity is a common characteristic for wound rolls of elastomerics and film.

When the wound roll of a web produced by VFL, SBL or as registered film is produced at constant WOT, the tension in the web adjacent to the roll's core and at the outside diameter of the roll is normally equal to the WOT if wound on a sufficiently rigid core. Elsewhere within the wound roll, the tension in the web is lower than the WOT, and so it can be said that there is a deficit in the thru-roll tension. This deficit results because the outer layers in the roll compress the layers underneath them. In order to make the tension in the web inside the wound roll uniform regardless of where in the roll the tension is measured, i.e., in order to make the thru-roll tension uniform, the WOT needs to be controlled to compensate for the deficit in the thru-roll tension that would have been created had the roll been wound at constant WOT. This compensation technique is called "WOT Transposition." When the web material is wound onto the roll using a compensated WOT profile, which varies with the diameter of the web in a manner that was calculated using WOT transposition, then the thru-roll MD tension of the resulting web material inside the wound roll becomes substantially uniform.

Additional objects and advantages of the present disclosure will be set forth in part in the description that follows, and in part will be obvious from the description, or may be learned by practice of the present disclosure.

The accompanying drawings, which are incorporated in and constitute a part of this specification, illustrate at least one presently preferred embodiment of the present disclosure as well as some alternative embodiments. These drawings, together with the description, serve to explain the principles of the present disclosure but by no means are intended to be exhaustive of all of the possible manifestations of the present disclosure.

BRIEF DESCRIPTION OF THE DRAWINGS

A full and enabling disclosure of the present disclosure, including the best mode thereof to one skilled in the art, is set forth more particularly in the remainder of the specification, including reference to the accompanying figures, in which.

Figure 6:
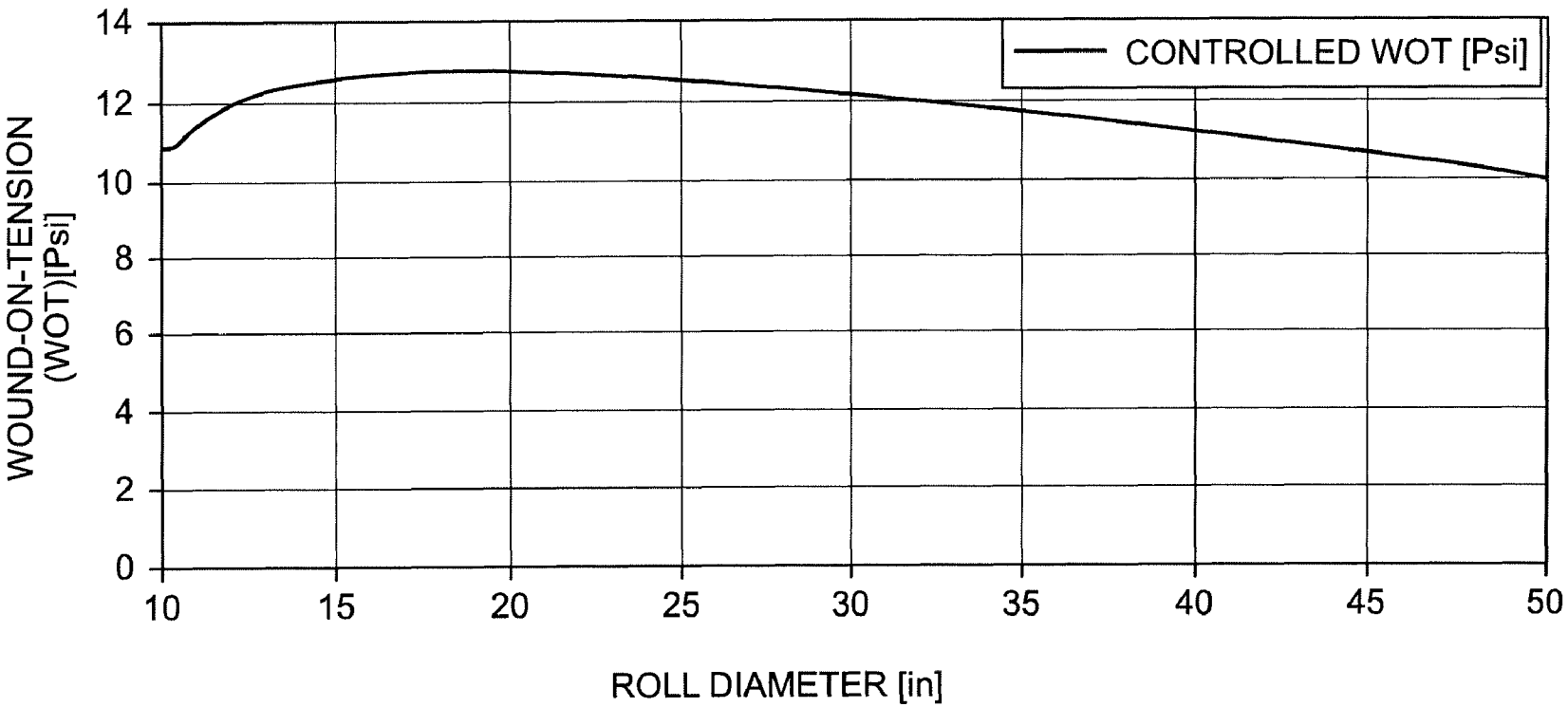
FIG. 6 schematically shows the controlled wound-on-tension (WOT) that was calculated in accordance with an embodiment of the present disclosure to be used during the winding of an embodiment of a desired web that is to be created in accordance with an embodiment of the present disclosure.

within the roll for a roll wound using a controlled WOT profile (depending on the diameter being wound on the roll, e.g., as in FIG. 6) and the measured MD strain within a roll (curve of diamond data points) wound using a constant WOT (as in FIG. 2) regardless of the diameter being wound on the roll.

Figure 10A:
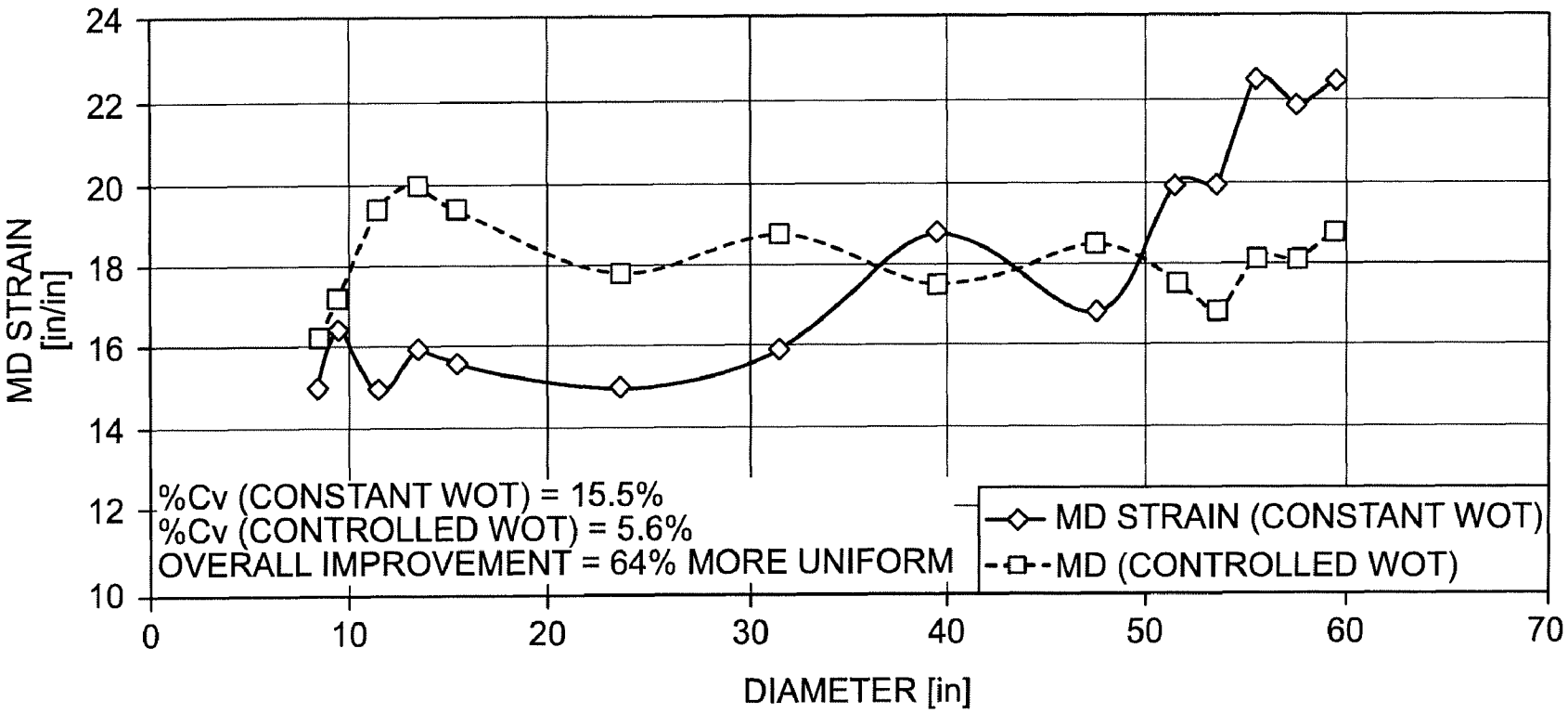
FIG. 10*a* graphically presents for a first VFL material as a function of the diametral position in the roll, a comparison between the measured MD strain (curve of square data points)
Figure 10B:
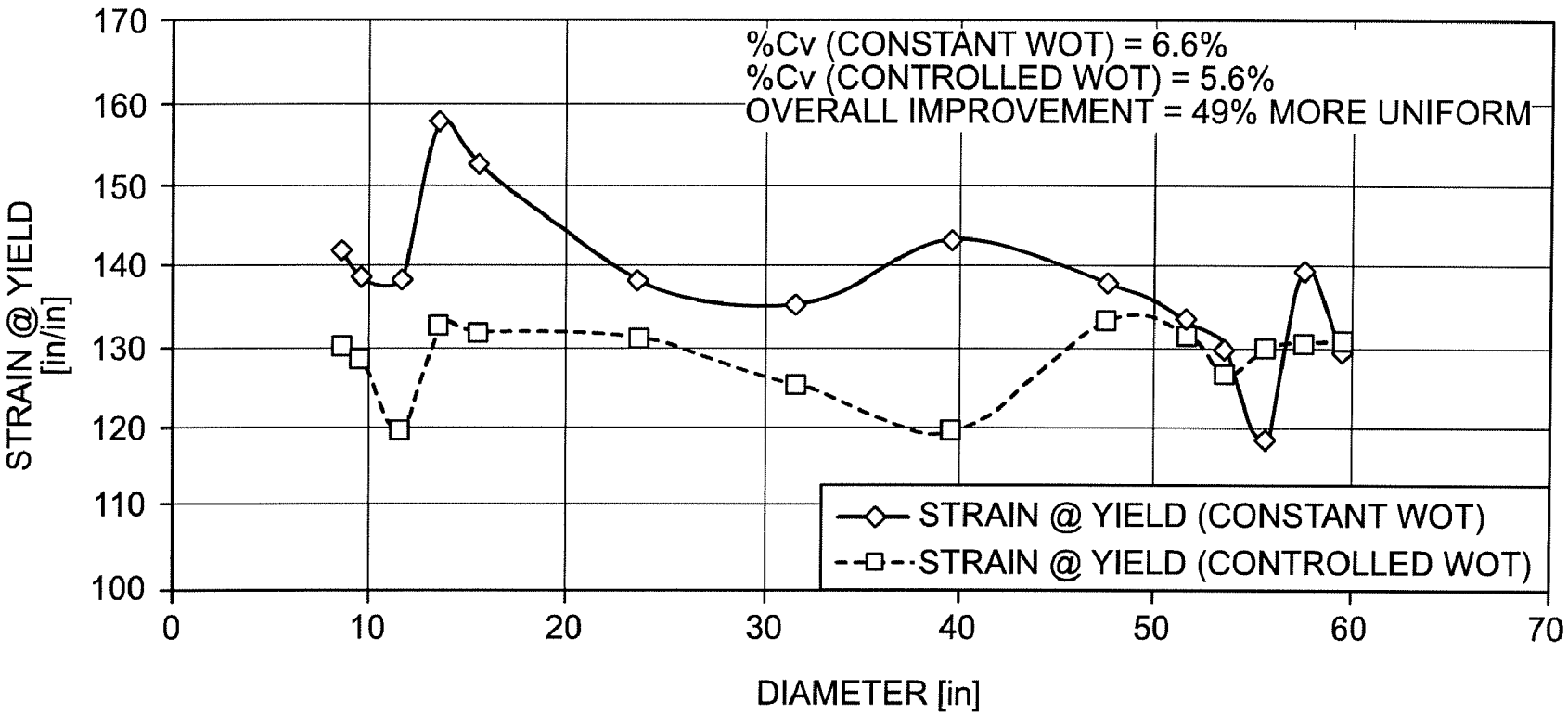

FIG. 10*b* graphically presents for the same first VFL material and conditions as in FIG. 10*a* as a function of the diametral position in the roll, a comparison between the measured MD strain at yield (curve of square data points) within the roll for a roll wound using a controlled WOT profile (depending on the diameter being wound on the roll, e.g., as in FIG. 6) and the measured MD strain within a roll (curve of diamond data points) wound using a constant WOT (as in FIG. 2) regardless of the diameter being wound on the roll.

Figure 10C:
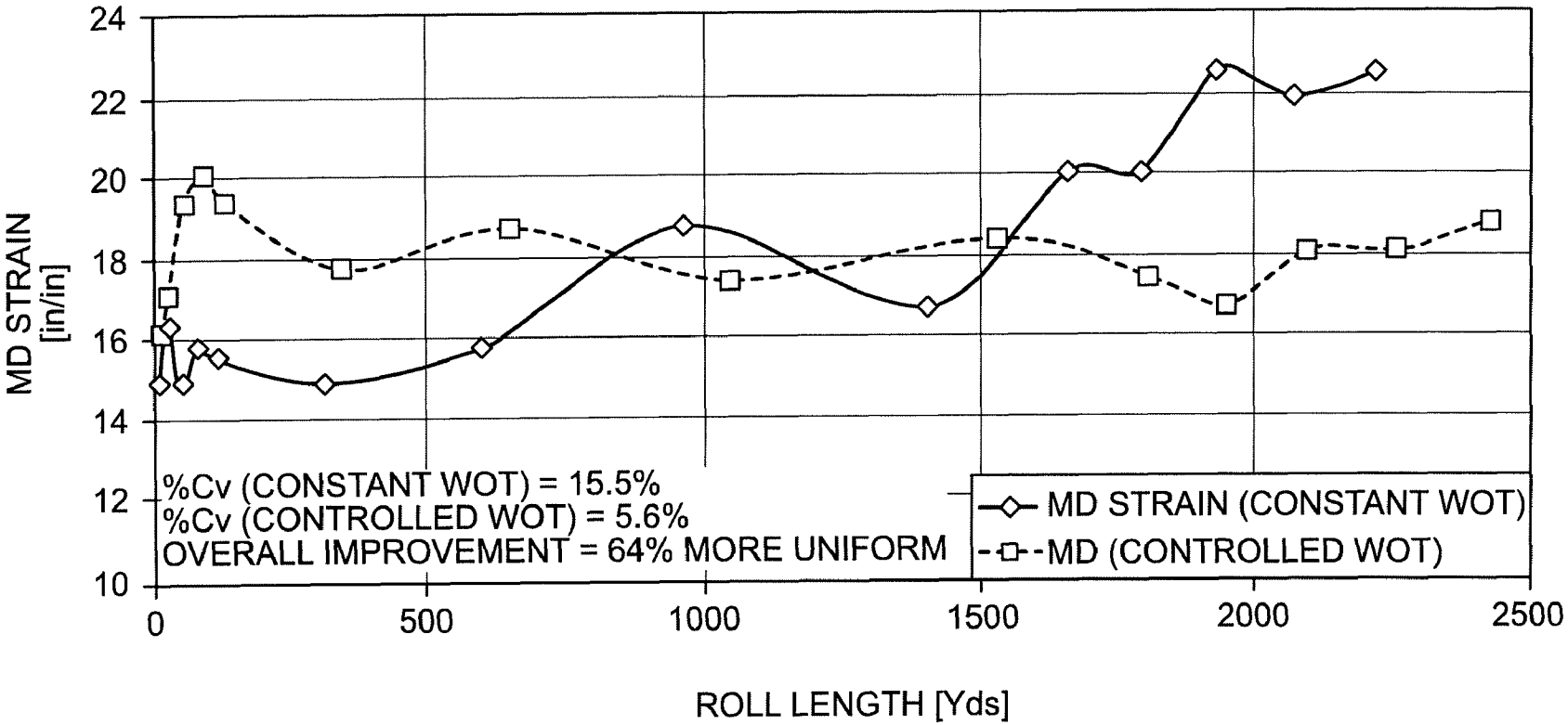

FIG. 10*c* graphically presents for the same first VFL material and conditions as in FIG. 10*a* but as a function of the roll's length from the core to the free end, a comparison between the measured MD strain (curve of square data points) within the roll for a roll wound using a controlled WOT profile (e.g., as in FIG. 6) and the measured MD strain within a roll (curve of diamond data points) wound using a constant WOT (as in FIG. 2) regardless of the diameter being wound on the roll.

Figure 10D:
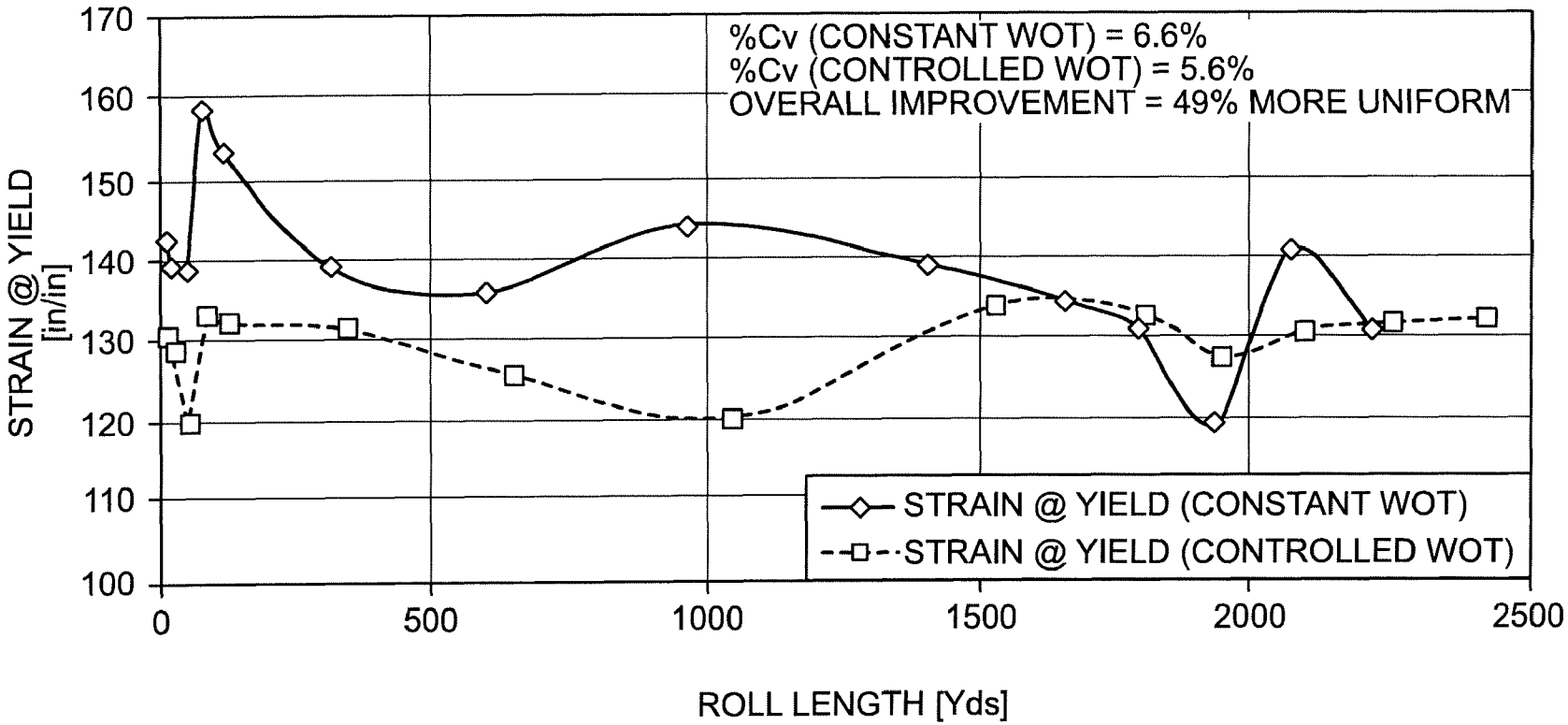

FIG. 10*d* graphically presents for the same first VFL material and conditions as in FIG. 10*a* but as a function of the roll's length from the core to the free end, a comparison between the measured MD strain at yield (curve of square data points) within the roll for a roll wound using a controlled WOT profile (depending on the diameter being wound on the roll, e.g., as in FIG. 6) and the measured MD strain within a roll (curve of diamond data points) wound using a constant WOT (as in FIG. 2) regardless of the diameter being wound on the roll.

FIG. 10*e* is a table that presents the data that is used for the curves of the diamond data points and square data points shown in FIGS. 10*a* through 10*d*.

Figure 11A:
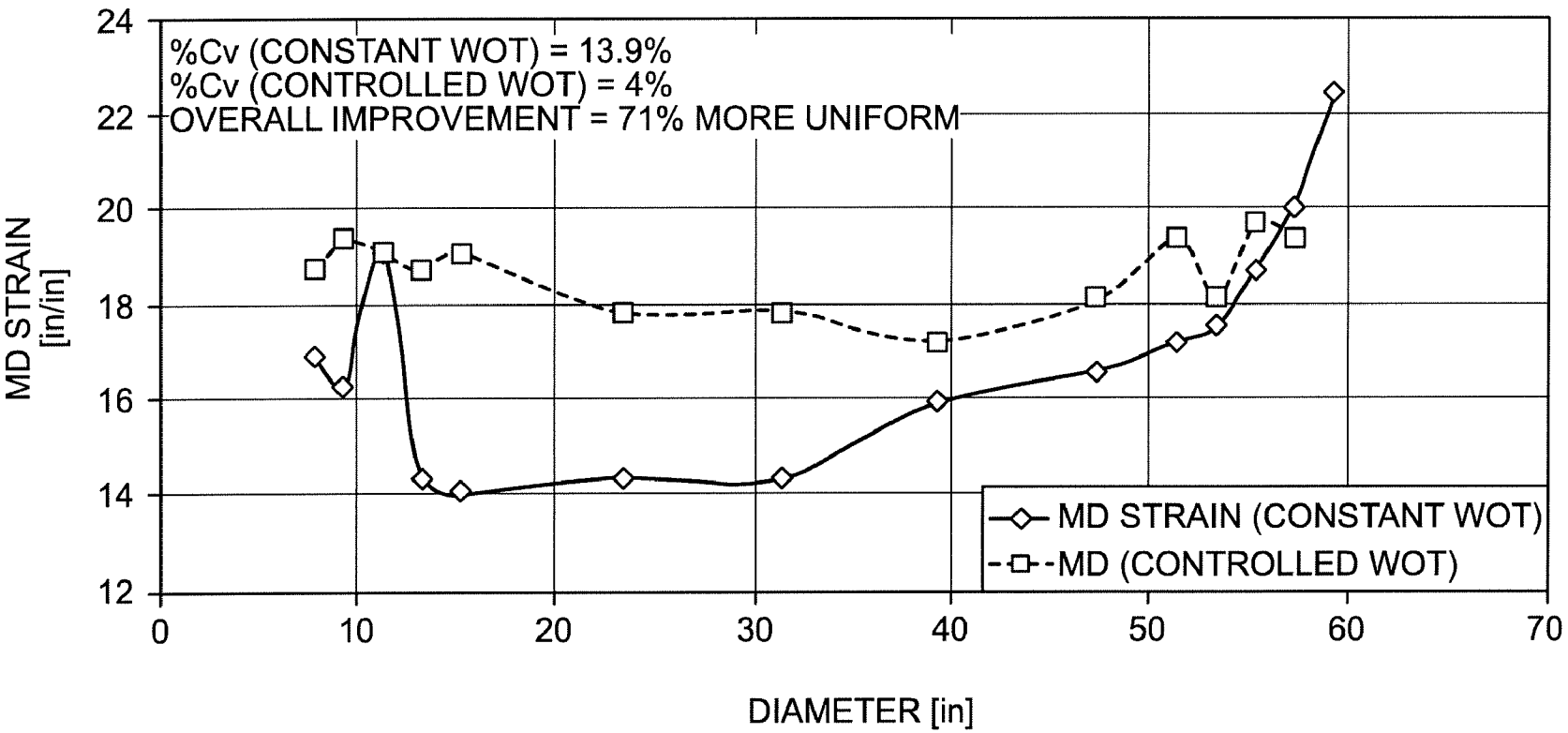

FIG. 11*a* graphically presents for a second VFL material as a function of the diametral position in the roll, a comparison between the measured MD strain (curve of square data points) within the roll for a roll wound using a controlled WOT profile (depending on the diameter being wound on the roll, e.g., as in FIG. 6) and the measured MD strain within a roll (curve of diamond data points) wound using a constant WOT (as in FIG. 2) regardless of the diameter being wound on the roll.

Figure 11B:
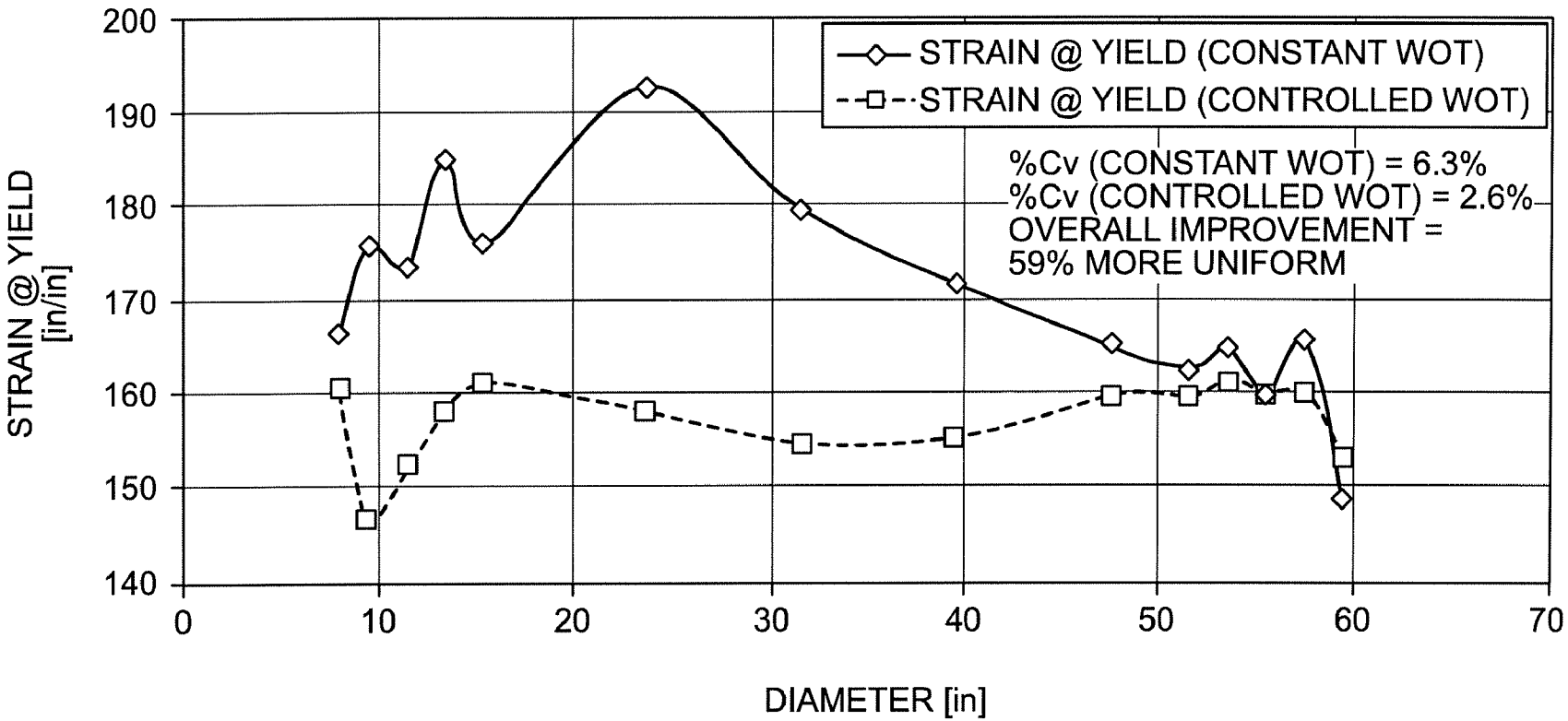

FIG. 11*b* graphically presents for the same second VFL material and conditions as in FIG. 11*a*, a comparison between the measured MD strain at yield (curve of square data points) for the web within the roll for a roll wound using a controlled WOT profile (depending on the diameter being wound on the roll, e.g., as in FIG. 6) and the measured MD strain at yield for the web within a roll (curve of diamond data points) wound using a constant WOT (as in FIG. 2) regardless of the diameter being wound on the roll.

Figure 11C:
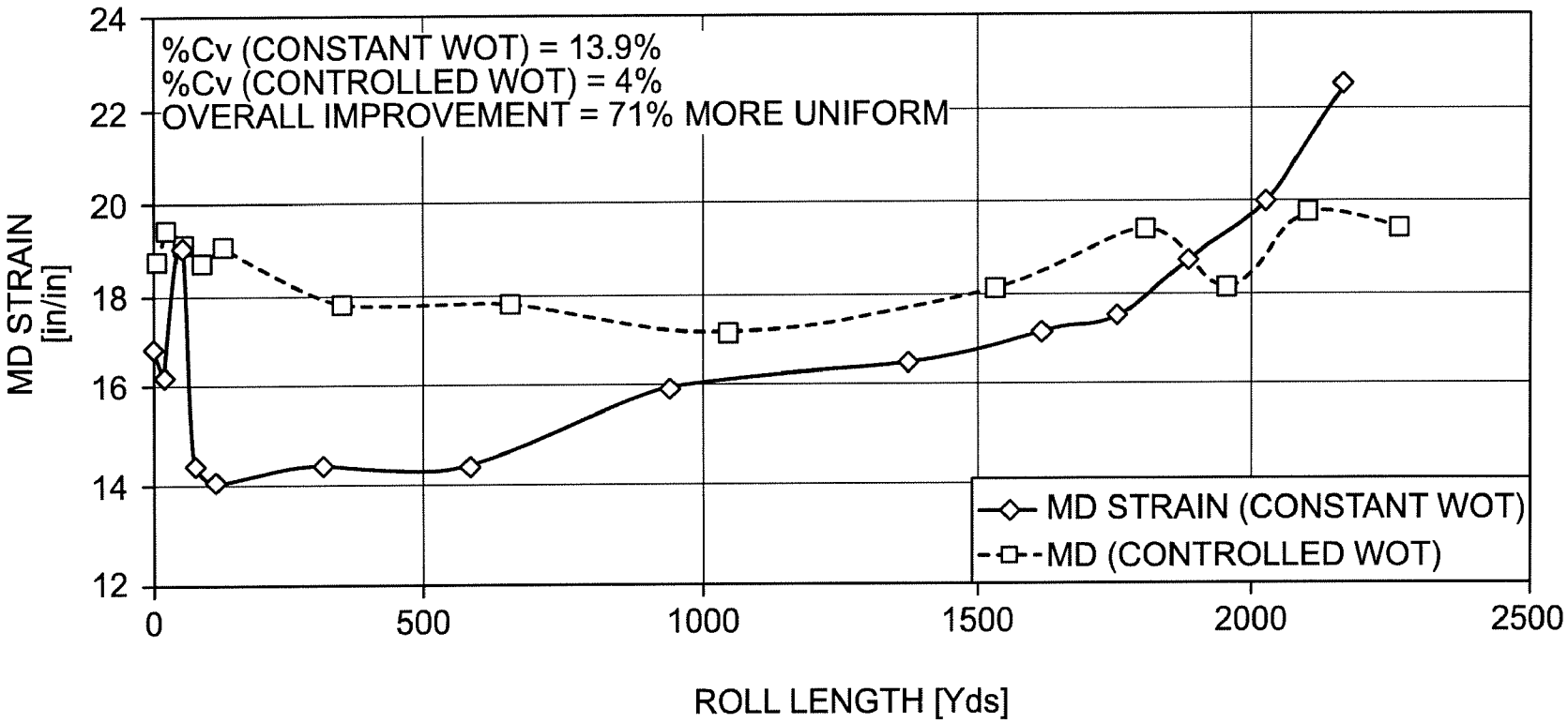

FIG. 11*c* graphically presents for the same second VFL material and conditions as in FIG. 11*a* but as a function of the roll's length from the core to the free end, a comparison between the measured MD strain (curve of square data points) within the roll for a roll wound using a controlled WOT profile (e.g., as in FIG. 6) and the measured MD strain within a roll (curve of diamond data points) wound using a constant WOT (as in FIG. 2) regardless of the diameter being wound on the roll.

Figure 11D:
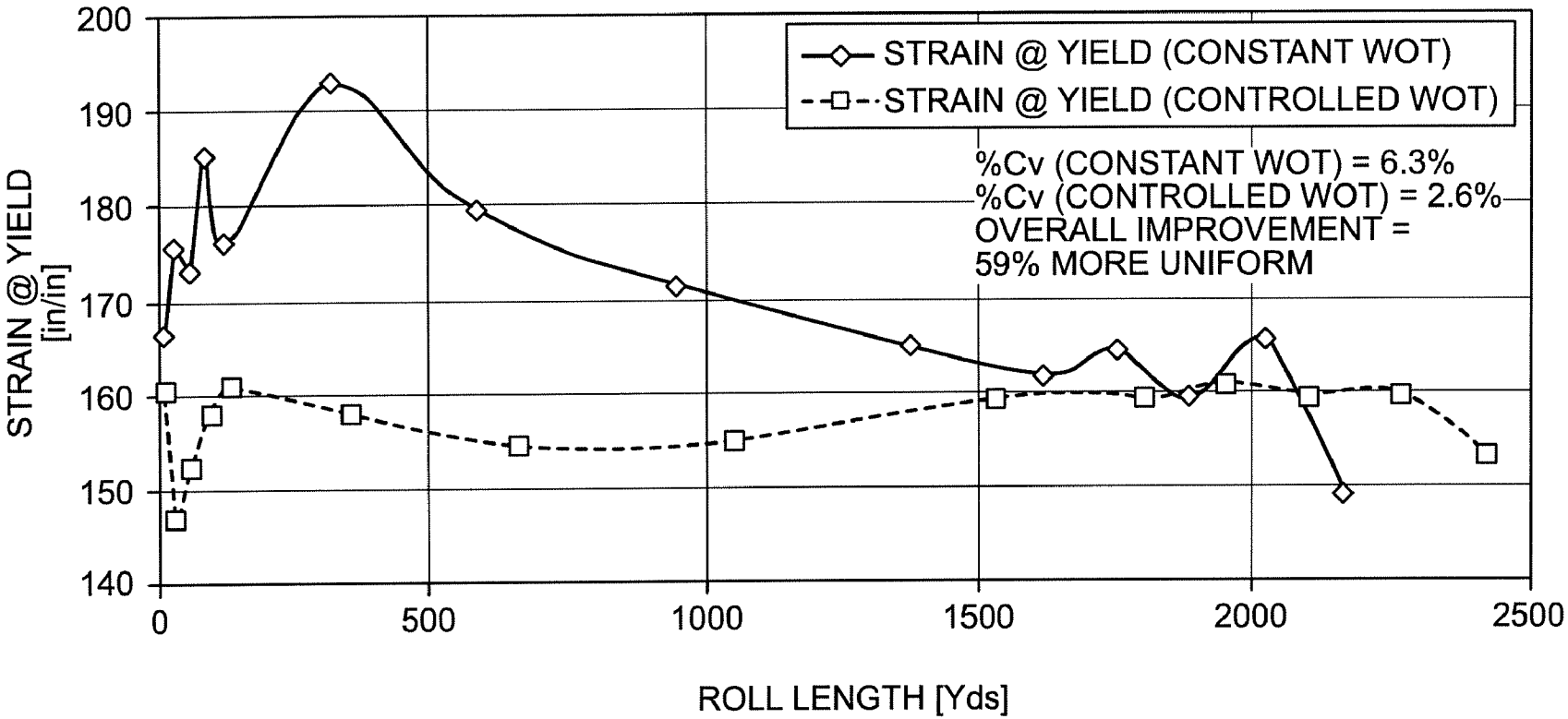

FIG. 11*d* graphically presents for the same second VFL material and conditions as in FIG. 11*a* but as a function of the roll's length from the core to the free end, a comparison between the measured MD strain at yield (curve of square data points) within the roll for a roll wound using a controlled WOT profile (depending on the diameter being wound on the roll, e.g., as in FIG. 6) and the measured MD strain within a roll (curve of diamond data points) wound using a constant WOT (as in FIG. 2) regardless of the diameter being wound on the roll.

FIG. 11*e* is a table that presents the data that is used for the curves of the diamond data points and square data points shown in FIGS. 11*a* through 11*d*.

Figure 12:
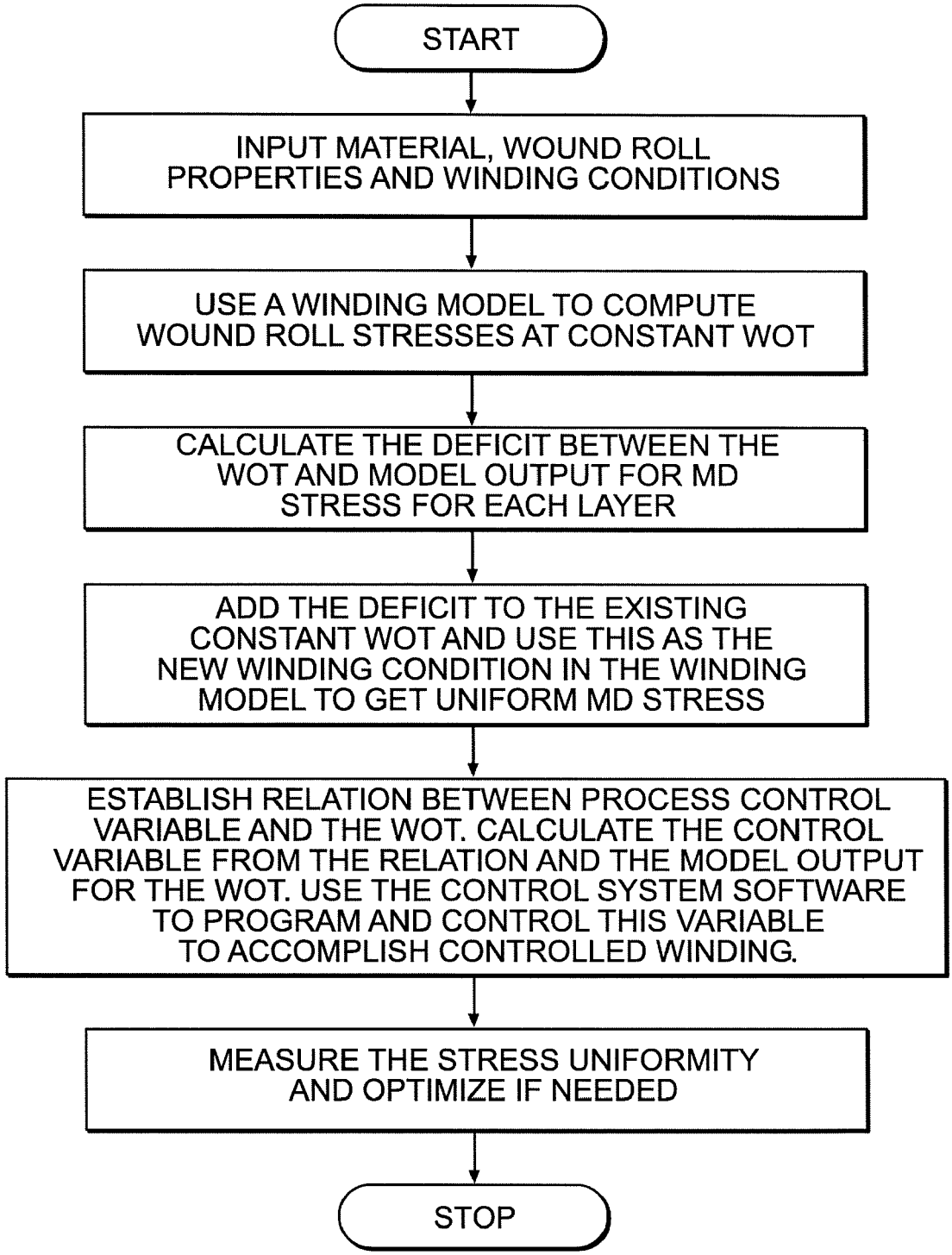

FIG. 12 schematically presents in the form of a flow chart, steps that can be taken to practice an embodiment of the method of the present disclosure that yields a roll of constant MD stress after having been wound using a controlled WOT profile that varies the WOT depending on the diameter being wound on the roll (e.g., as in FIG. 6).

Repeat use of reference characters in the present specification and drawings is intended to represent the same or analogous features or elements of the present disclosure.

DETAILED DESCRIPTION

Reference now will be made in detail to the presently preferred embodiments of the present disclosure, one or more examples of which are illustrated in the accompanying drawings and appendices. Each example is provided by way of explanation of the present disclosure, which is not restricted to the specifics of the examples. In fact, it will be apparent to those skilled in the art that various modifications and variations can be made in the present disclosure without departing from the scope or spirit of the present disclosure. For instance, features illustrated or described as part of one embodiment, can be used on another embodiment to yield a still further embodiment. Thus, it is intended that the present disclosure cover such modifications and variations as come within the scope of the appended claims and their equivalents.

Figure 1:
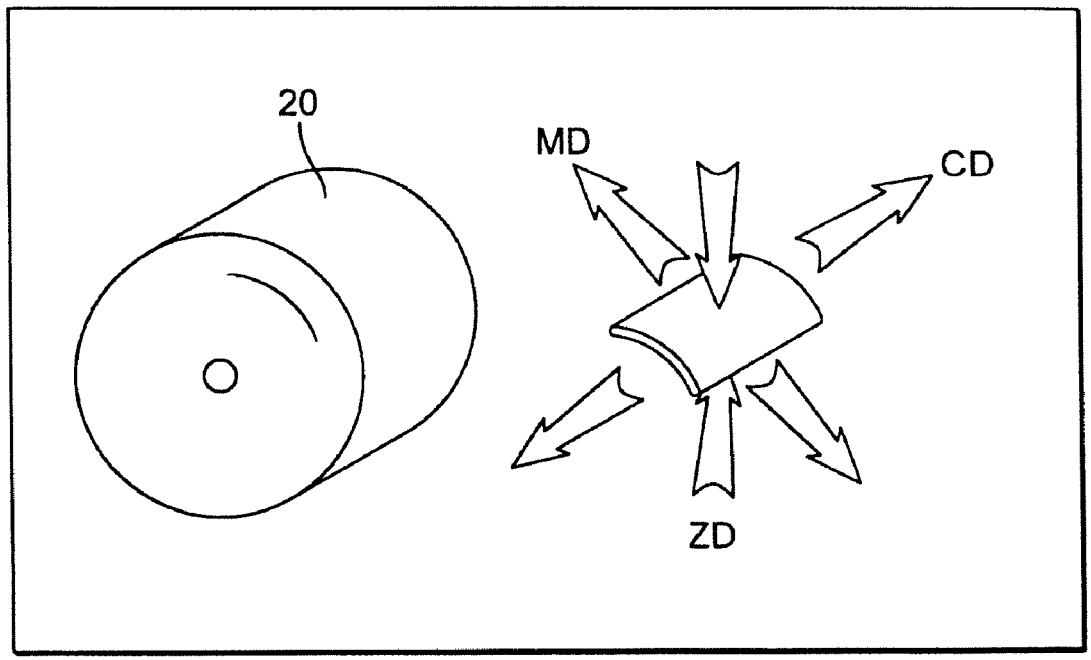
FIG. 1 schematically shows a wound roll of elastic, viscoelastic or viscoplastic continuous web and the directions of the three principal stresses on a section of the web inside of the roll.

FIG. 1 schematically shows a wound roll 20 of continuous VFL elastomeric web and the directions of the three principal stresses on a section of the web inside of the roll. Accordingly, as shown in FIG. 1, the arrows designated MD show the direction of the wound on tension (WOT), while the arrows designated ZD show the interlayer pressure acting in the radial direction with respect to the roll. Typically, in most web process machinery, wound rolls of webs are wound at constant wound on tension "WOT" (tension in the current winding layer, i.e., outermost layer, of the wound roll). One exception would be the use of taper tension or nip for film rolls to reduce roll blocking. When the MD modulus and ZD modulus of a web material are very close to each other and the roll had been wound at constant wound-on-tension, then the wound roll of that material exhibits a unique signature of thru-roll stored-in MD stress. In a converting process, during unwinding of the roll, the state of any given section of the web is different depending on the diametral location where that section was stored on the roll.

In many processes employing continuous webs that are unwound from a wound roll, it is desirable to have as little variation in the state of the web as possible as the web is unwound so that the state of the web is essentially uniform whether the web comes off the outermost diameter of the roll, the innermost diameter of the roll or somewhere in between the two extreme diameters of the roll. In order to achieve such desired uniformity in the state of the web, the physics of the wound roll can be manipulated in accordance with the present disclosure in order to provide a roll with substantially uniform thru-roll stored-in MD stress. For a given material, core and wound roll configurations, the state of stress inside the wound roll is determined by the WOT. Hence, in accordance with the present disclosure, by manipulating the WOT to follow a compensated WOT profile as the web material is being wound onto the roll, it has been found possible to achieve a substantially uniform MD stress in the resulting wound roll. As noted above, as a first step in this process, a winder computer model is used to determine the initial MD tension conditions within a wound roll of the continuous web material as a function of the wound roll diameter, assuming a constant WOT in the web material as that web material is being wound onto the roll. As noted above, this winder computer model is based on Hakiel's nonlinear model for wound roll stresses referenced above but modified to incorporate the new procedure that is described in this disclosure and a suitable winder computer program is presented herein as Appendix A.

Required Input Values:

Wound roll properties:

MD modulus, ZD modulus and Poisson's ratio of the web material

Web thickness

Wound roll outer diameter

Wound-on-tension (WOT)

Core properties:

Inner and outer diameter of core

Young's modulus, Poisson's ratio

EXAMPLE ONE

For example, consider a material whose properties are listed below.

Web, wound roll properties:

MD Modulus=25 Psi

ZD Modulus→$K_1$=0.1, $K_2$=10 Psi (Pfeiffer's form—given in Hakiel's paper)

Poisson's ratio=0.03

Wound roll diameter=50 in

Wound roll width=6 in

Wound-on-tension=10 Psi

Core properties:

Core inner diameter=9 in

Core outer diameter=10 in

Core modulus=100000 Psi

Core Poisson's ratio=0.3

Figure 2:
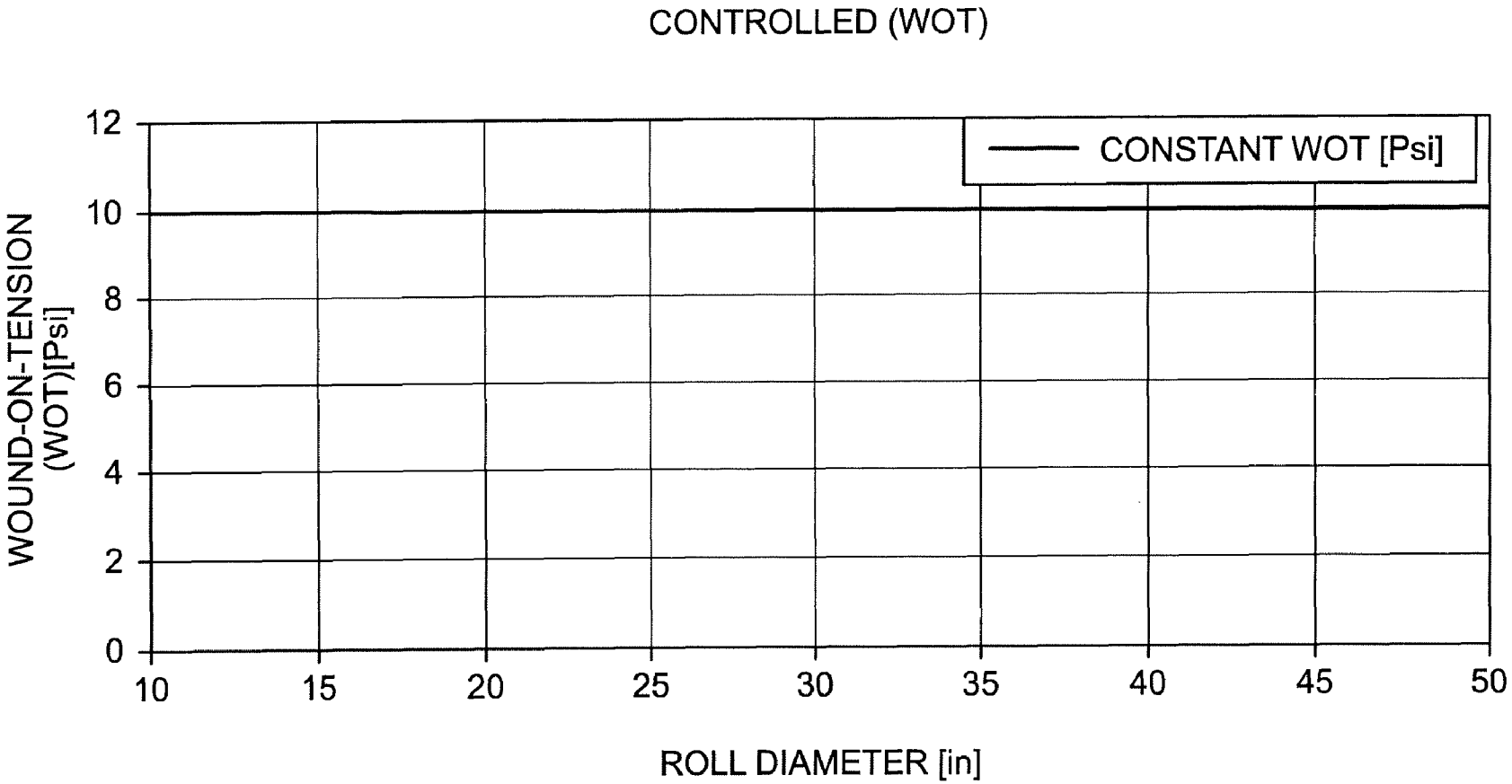
FIG. 2 schematically shows the constant wound-on-tension (WOT) of 10 Psi that was used during the winding of the web with properties listed in Example One to produce the roll of Example One.
Figure 3:
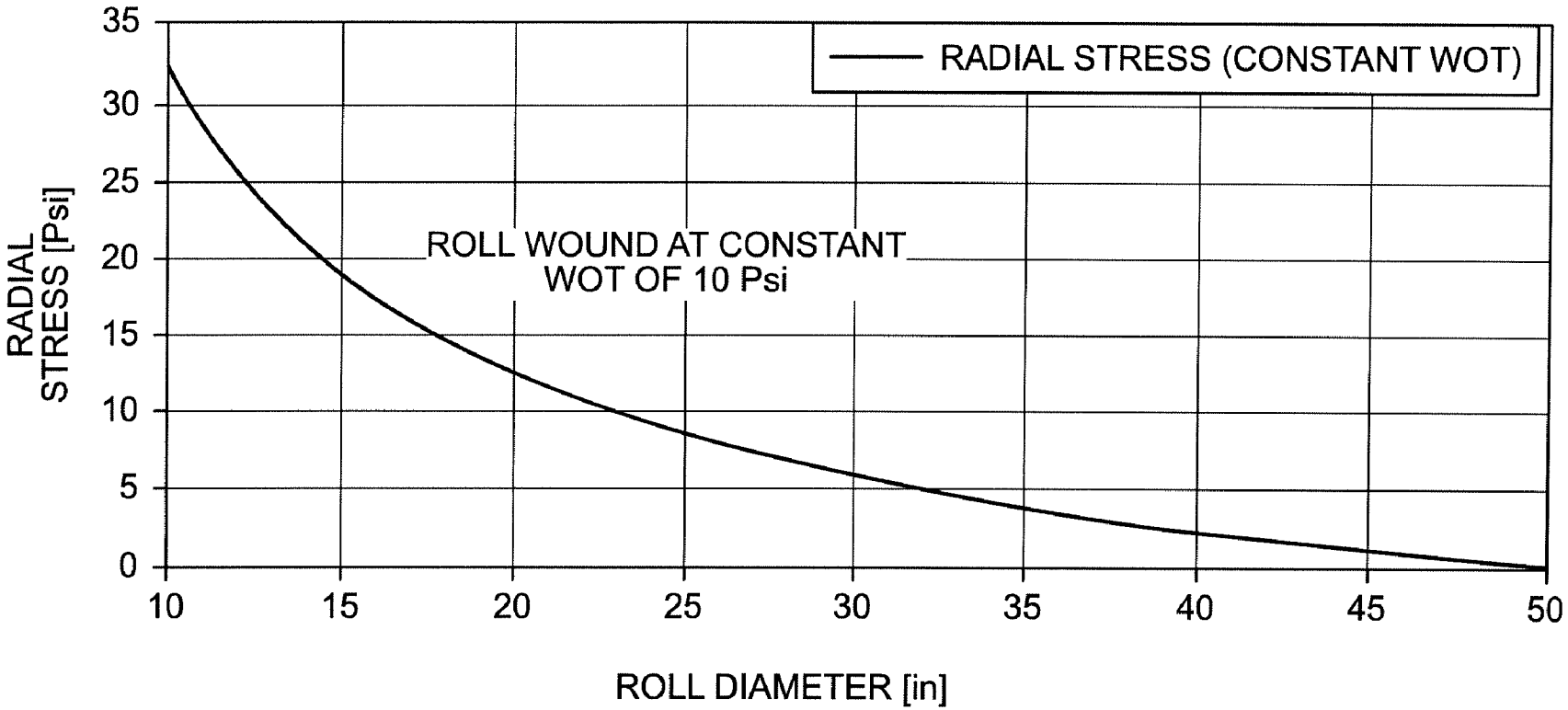
FIG. 3 schematically shows the unique thru-roll stress profile of the radial stress for a wound roll according to Example One that was wound at a constant wound-on-tension (WOT) of 10 Psi.
Figure 4:
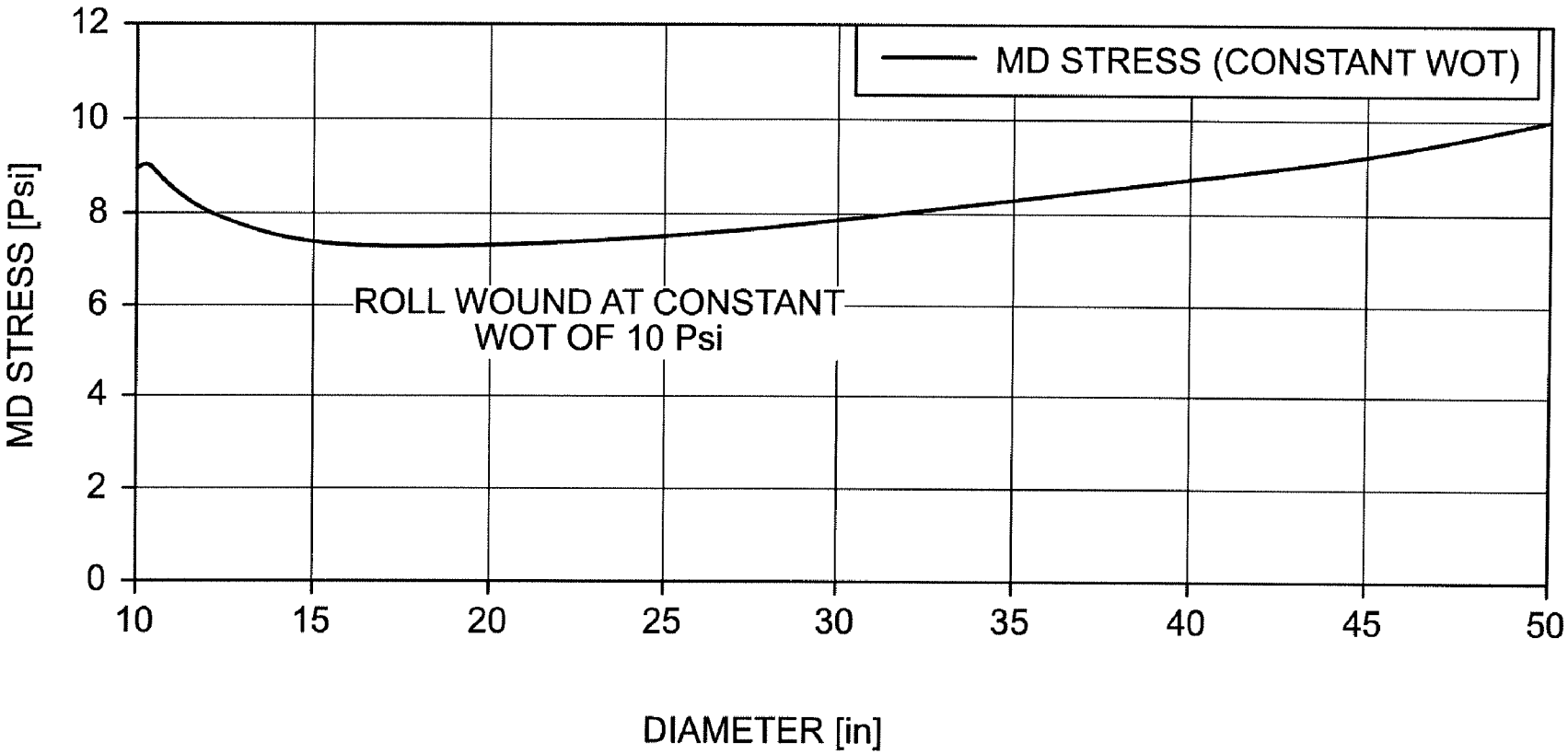
FIG. 4 schematically shows the unique thru-roll stress profile of the MD stress for a wound roll according to Example One that was wound at a constant wound-on-tension (WOT) of 10 Psi.

Consider a roll that has been wound at constant wound-on-tension (WOT) of 10 Psi for the web with properties listed above as shown in FIG. 2. The unique thru-roll stress profile for such a wound roll of this web material for radial stress is shown in FIG. 3, and the unique thru-roll stress profile for such a wound roll of this web material for MD stress is shown in FIG. 4. A modified version of Hakiel's model can be used to generate a winder computer program that computes the stresses and the results that are graphically presented in FIGS. 3 and 4. The computer program presented in Appendix A is an embodiment of such a winder computer program that was used to generate the data presented in FIGS. 3 and 4. Appendix B is an example of an Excel screen shot that has input values and output values (numerical and graphs) for the winder computer program that is presented in Appendix A. For each of the selected data points, the winder computer program generates a predicted compensated WOT value for achieving substantially uniform thru-roll MD tension in the wound roll that has a fifty inch outside diameter wound on a core with a ten inch outside diameter. These data points provide a compensated WOT profile as a function of the diameter of the wound roll of web material. The compensated WOT profile can be inputted into software that converts the data points into a smooth draw control program for the winder so as to achieve substantially uniform thru-roll MD tension in the web material that the winder, so controlled, will wind onto the roll.

Since the desired property is the thru-roll MD stress, the WOT needs to be controlled to make this MD stress property substantially uniform. This can be done in accordance with the present disclosure by using "WOT Transposition" to correct the constant WOT winding profile to obtain a controlled (aka compensated) WOT winding profile that can be employed to wind the material into a hard roll that exhibits properties (including MD stress in the web) that are substantially uniform thru-roll.

Figure 5:
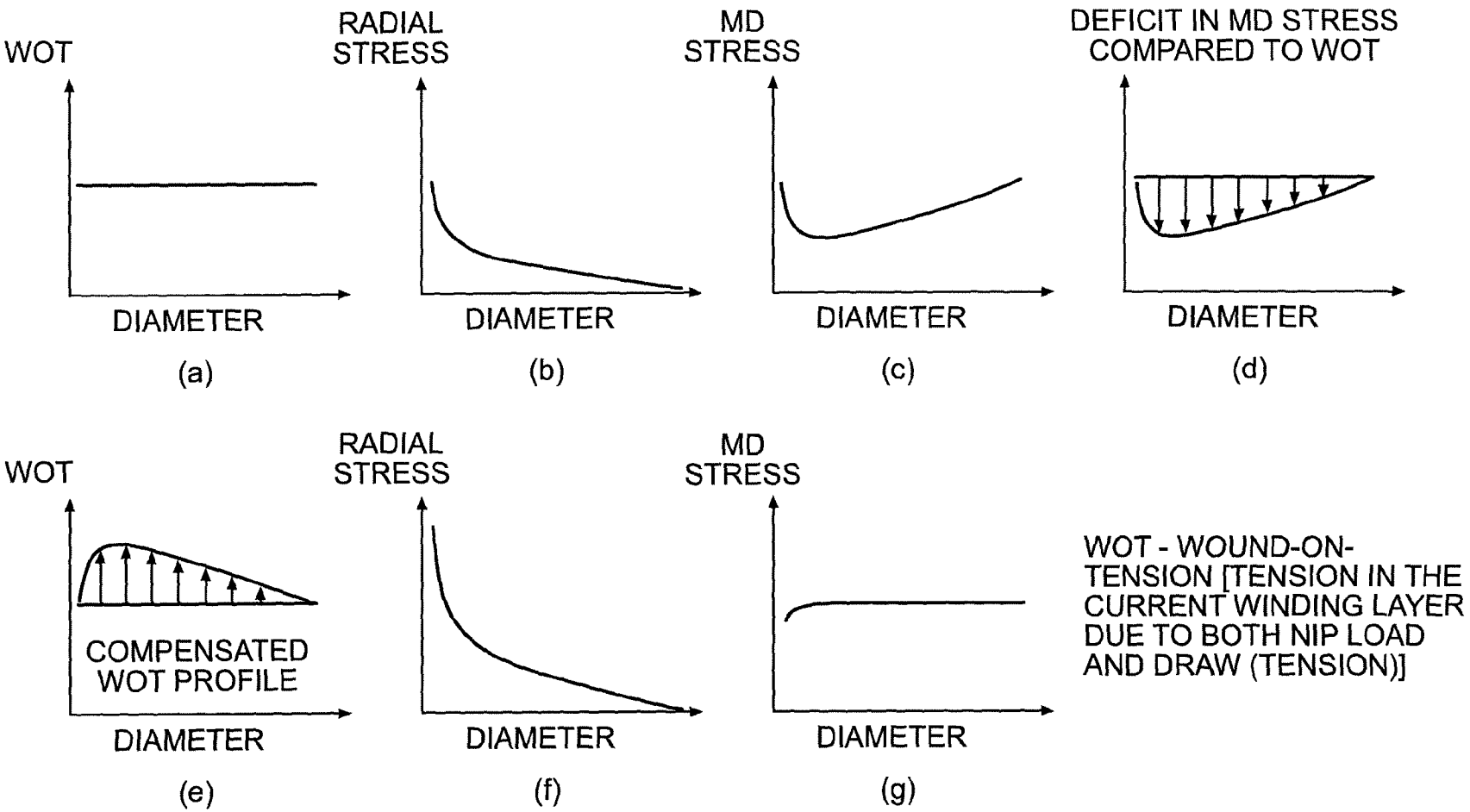
FIG. 5 schematically explains the "WOT Transposition" concept in accordance with an embodiment of the present disclosure.

The "WOT Transposition" concept has been explained schematically in FIG. 5. Since MD stress decreases with increased diameter for a fully compressed roll, then a WOT profile that compensates for the deficit in the in-roll tension at each diametral location had such roll been wound at constant Wound on Tension "WOT," should produce uniform thru-roll tension in the wound roll. This is the so-called compensated WOT profile that is needed in the web as the web is being wound onto the roll in order to provide the wound roll with a substantially uniform thru-roll MD tension and other web properties.

Winding a roll of web material at a constant WOT as shown in FIG. 5(*a*) will produce a radial stress profile shown in FIG. 5(*b*) for fully compressed rolls. Since the WOT is the tension at which the web enters the roll, then it follows that the in-roll tension cannot be any higher than this constant value of the WOT. When wound at constant WOT as shown in FIG. 5(*c*), the MD stress inside the wound roll of web material will dip below the constant value of the WOT, and a plot of this MD stress inside the wound roll as a function of the diametral location within the roll will exhibit a shape resembling the 'Nike®-Swoosh®' profile. Thus, at each of the intermediate diametral locations within the roll, there is a deficit between the MD stress inside the wound roll and the constant WOT at which the web material was wound onto the roll.

If this deficit (between the constant WOT shown in FIG. 5(*a*) and the MD tension in the wound roll shown in FIG. 5(*c*)) as shown in FIG. 5(*d*) is added to the constant value of WOT as shown in FIG. 5(*e*) at corresponding diametral locations, the generated radial pressure as shown in FIG. 5(*f*) will be higher than the radial pressure generated at constant WOT value. Though the generated radial pressure values are higher, the thru-roll MD stress is now substantially uniform as shown in FIG. 5(*g*). Although the MD stresses are non-uniform very near the core, they are substantially uniform elsewhere. Moreover, in terms of in-roll length, the yardage in the non-uniform MD stress zone very near the core accounts for less than about 2% of the entire in-roll length. Thus, using the technique of the present disclosure, the thru-roll MD stress now can be substantially uniform over about 98% of the entire web length measured from the outside diameter of the wound roll inwardly toward the core of the wound roll. For this technique to work, one has to bear in mind that the roll should be a "hard" roll, i.e., a fully compressed roll.

Referring to Example One, observe that at the outer diameter of the hard roll, the MD stress is equal to the value of the WOT, which in this case is 10 Psi. Elsewhere in the hard roll, the MD stress inside the wound hard roll does not exceed the value of the WOT. In this case, this value is 10 Psi.

Given a diametral location, the MD stress is less than the WOT by an amount 'Xd', where 'X' corresponds to the difference between the WOT and the MD stress, and 'd' corresponds to the diametral location. If this deficit 'Xd' is added to the WOT as corresponding diameters of the roll are being wound, then a new compensated WOT profile that varies as a function of the diameter (instead of being constant as in FIG. 2) can be obtained. This new compensated WOT profile is shown in FIG. 6 and resembles a Type 1 combined exponential and power function curve $y=a X^b c^x$ where a>0, b=2, c=0.5 and $x \epsilon [0,10]$.

Figure 7:
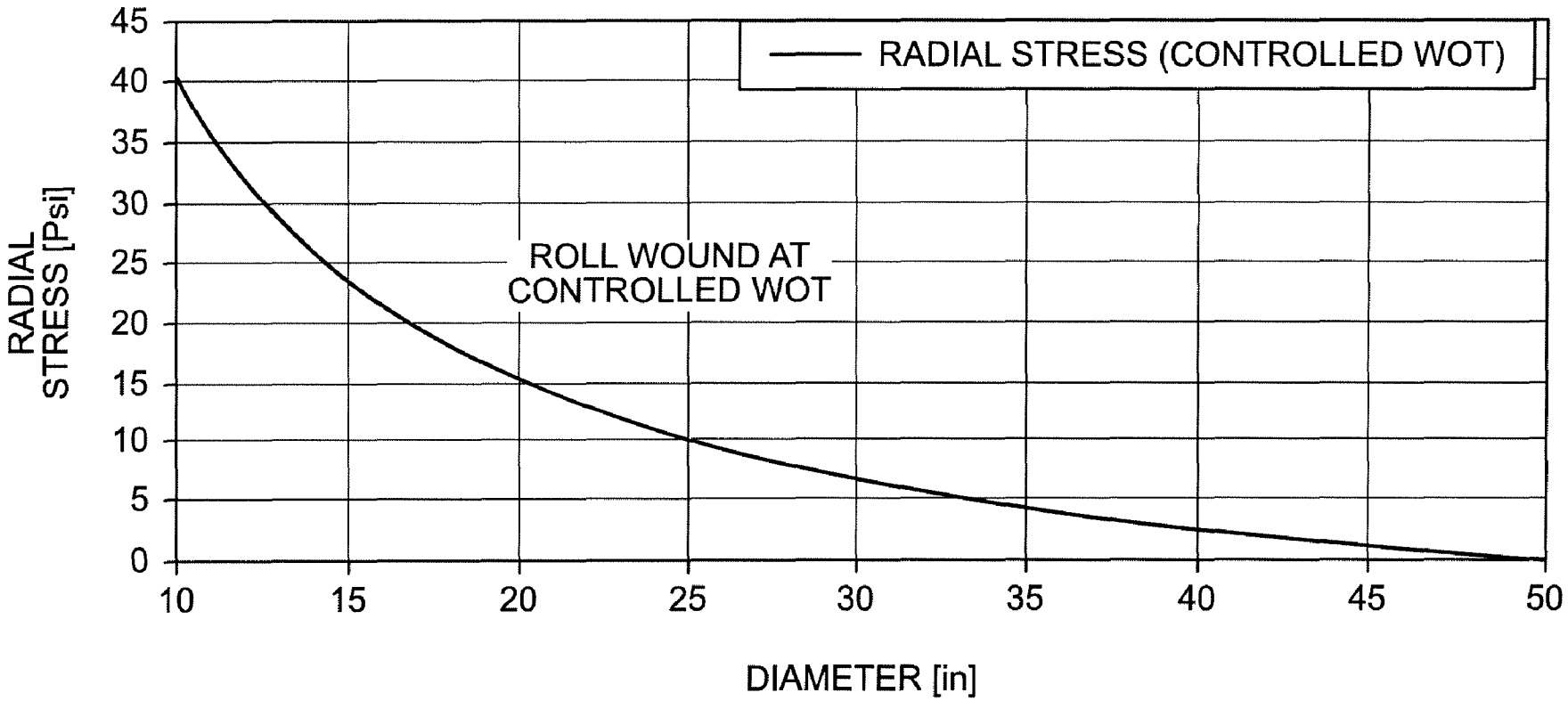
FIG. 7 schematically shows the effect on the radial stresses inside a roll configured as in Example One that has been wound using a controlled WOT in accordance with the embodiment of FIG. 6.
Figure 8:
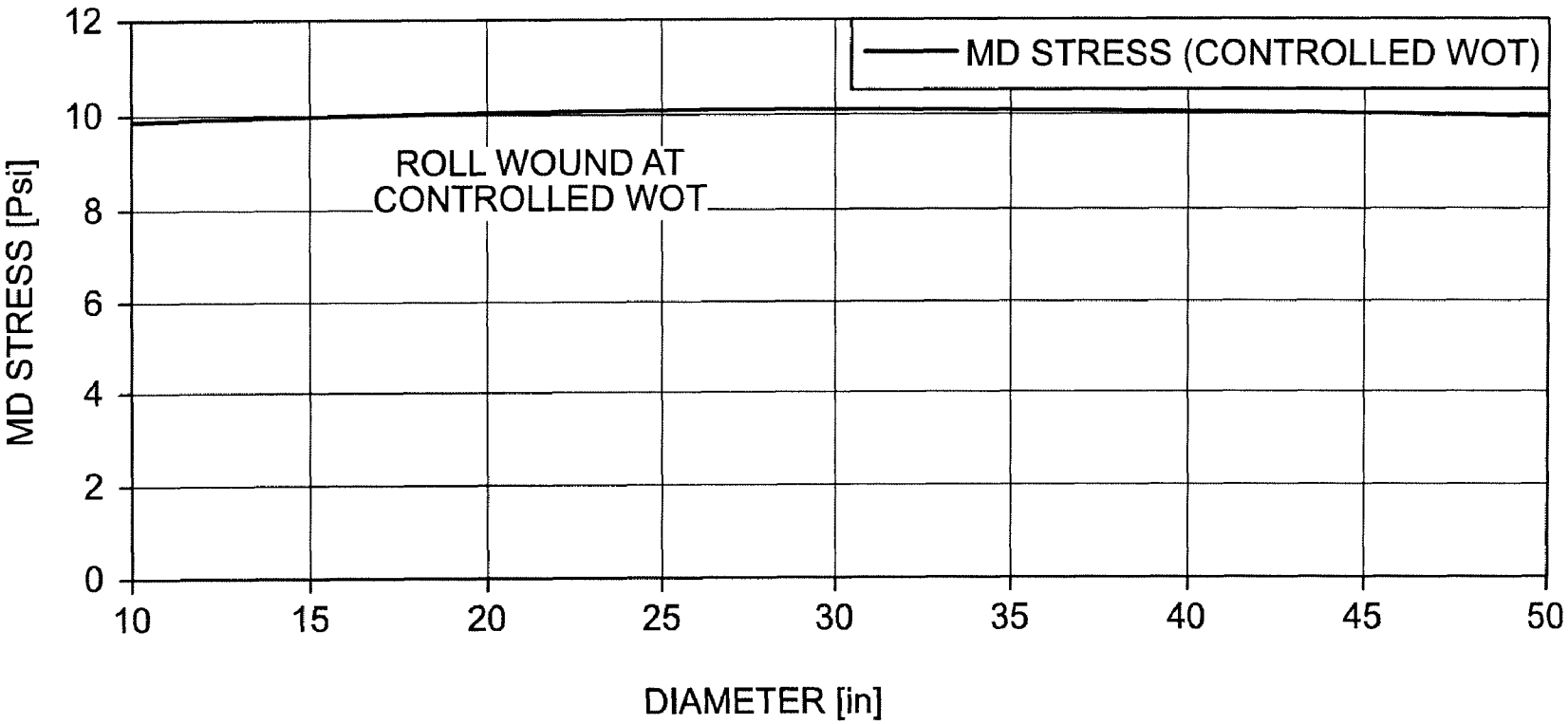
FIG. 8 schematically shows the effect on the MD stresses inside a roll configured as in Example One that has been wound using a controlled WOT in accordance with the embodiment of FIG. 6.

The same computer program that implements the winder computer model is then used to calculate the stresses in a roll that was wound using the compensated WOT profile that is shown in FIG. 6. FIG. 7 graphically presents these radial stresses calculated by this same winder computer program for the web inside the wound roll that would be created using the compensated WOT profile that is shown in FIG. 6. The MD stresses inside the wound roll that would be created using the compensated WOT profile that is shown in FIG. 6 are calculated by the same winder computer program, and these calculations are shown in FIG. 8. Observe that at each diametral location, the radial stresses shown in FIG. 7 are slightly higher than those shown in FIG. 3, which is due to an overall higher WOT. However the MD stresses shown in FIG. 8 are nominally constant and substantially uniform thru-roll as a result of using a controlled WOT (shown in FIG. 6 for this particular embodiment).

This method in accordance with the present disclosure will work for webs that have MD modulus and ZD modulus that are very close to each other.

For example, referring to the fourth column from the left in the chart in Appendix B, the web at 30 inch diameter of the roll wound at a constant WOT of 10 psi is predicted by the winder computer program (shown in Appendix A) to have a MD tension (stress) of 7.848 psi. That means that at this 30 inch diametral location within the wound roll of material there is a predicted deficit of 2.152 psi (10−7.848) from the maximum 10 psi MD tension that could be imparted to the web due to the constant 10 psi WOT being applied to wind the web onto the roll. To compensate for this 2.152 psi deficit at the 30 inch diameter of the roll, the compensated WOT profile calls for a WOT of 12.152 psi (10+2.152), which is what appears in the fifth column from the left in the chart in Appendix B under the heading "controlled WOT." Using the same winder computer model (shown in Appendix A), the MD tension (stress) in the web at the 30 inch diameter of the roll wound at the compensated WOT of 12.152 psi is calculated to be 10.061 psi in the seventh column from the left in the chart in Appendix B. As can be seen from an inspection of the other entries in the seventh column from the left in the chart in Appendix B, the MD tension in the roll of material wound according to the compensated WOT profile is predicted to be substantially uniform thru-roll at about 10 psi.

Winding Process Control

When low modulus stretchy materials are wound onto a roll, it is common to operate the winder in "draw control," wherein the compensated WOT profile is converted to speed control based on a known relation between the winder's speed and the MD tension in the web. Draw control (a.k.a. velocity control or speed control) works by controlling the speed of the winder and thereby controlling the MD tension in the web going into the winding roll. The control system, which typically can include a programmable logic controller (PLC), can be programmed to control the winder in a draw control mode. However, neither the velocity (expressed in feet per minute) nor the draw (expressed as %) is a direct measure of the web stress or the WOT. In order to determine the WOT, one must find an accurate way of expressing the relationship between the winder velocity and the WOT.

There are different methods that can be employed to establish a relationship between the draw (or velocity) and the WOT. One method uses a load cell that directly measures web tension in the process of winding the web into the roll. One could vary the draw and observe for the change in tension as measured by the load cell and establish a relation between the two. Another method calculates the stress in the web by multiplying the web strain and MD modulus of the web. The web strain can be calculated based on the velocity difference between the winder and the previous driven roller ([Vw−V1]/V1, where Vw is the winder velocity and V1 is the velocity of the roller prior to the winder).

While the methods that use draw control or velocity control presently are deemed more desirable, it is also possible to employ methods that use tension control, torque control or nip control. When the winding process runs in "tension control," then the tension in the web is a known quantity because a load cell that indicates the tension is already present in the process equipment. In this case, a relation can be established between the unwind motor current and the web tension for various brake levels. The same procedure can also be followed for torque-controlled winders. The PLC's control system software can be used to control the unwind motor current as a function of wound roll diameter by using a set of discrete points from the compensated WOT profile and interpolating between these points to accomplish the desired change in draw as a function of roll diameter.

Once the desired output for WOT that will yield substantially uniform thru-roll MD stress (as shown in FIG. 8 for example) is obtained as a function of the diameter of the roll as the web is being wound on to the roll, then the control system, which typically can include a programmable logic controller (PLC), can be programmed to control the winder (in draw control) and un-wind brake (in tension control). Common control system software for this purpose is available from Rockwell, Siemens, and many others for such process line equipment. These programs use their own programming language to control the various devices in the winding process.

In the case of draw control, the winding model output for WOT is converted to draw (or speed) based on the relation established between draw/speed and the WOT in the web. A simple program can then be written using the control system software to control the winder speed as a function of the wound roll diameter by using a set of discrete points from the winding model output and by linearly interpolating between these points to accomplish the change in the draw as a function of the diameter of the roll as the roll is then being wound. The conversion procedure is very similar for tension control, but in the tension control case it is the unwind motor current that is controlled as the roll is being wound. Thus, a PLC can be used to control the winder as a function of the compensated WOT profile in a tension control mode. For example, the PLC's control system software can be used to control the unwind motor current as a function of wound roll diameter by using a set of discrete points from the compensated WOT profile and interpolating between these points to accomplish the desired change in draw as a function of roll diameter.

In the case of nip control, the winding model output for WOT can be converted to the discreet nip loads that are required to obtain a target WOT for a given constant web tension. A general equation for WOT that can be used in the absence of empirical measurements of nip induced tension can be expressed as follows. $WOT=Tw+\mu N$, where WOT=Wound On Tension, Tw=Web Tension, $\mu$=Dynamic Web to Web Coefficient of Friction, and N=Nip Load.

Measure of MD Stress Uniformity

Once two rolls are wound—one wound using a controlled WOT as determined above (FIG. 6) and the other wound using a constant WOT (FIG. 2)—it becomes necessary to develop a protocol for measuring the MD stress of the web as a function of the diameter of the roll. Depending on the material and the requirements of the process, MD stress uniformity in a roll can be measured as having particular and predictable relationship to the measure of various other parameters that are more easily, i.e., directly, obtained by actual measurement. Some of the ways include the following. MD stress can be measured as the variation in length of each individual cut made in the web during the unwind process. MD stress also can be measured by documenting the repeat length of a printed graphic during unwind process. MD stress also can be measured as the variation of strain at the yield point of the web at different diametral locations during the unwind process. MD stress also can be measured by attaching strain gages to the web at various diametral locations and documenting the uniformity based on the uniformity of the strain measurements so obtained.

For example, the thru-roll "strain at yield" was actually measured. Briefly, sections (known as coupons) of same length were cut from the web at different diameters thru-roll, loaded on a tensile tester and stretched to a fixed load. Substantial uniformity in thru-roll strain in a roll of a very low modulus stretchable laminate web can be inferred from the "strain at yield point" during the unwinding process.

Strain at Yield

The step-by-step procedure for measuring the "strain at yield" parameter presented in the Figs. herein can be summarized as follows: Mark two lines 6 inches apart along the circumference of the roll (i.e., the marks are separated in the machine direction by 6 inches) at the outer diameter. Then cut from the material a coupon that is 8 inches long by 3 inches wide (in the cross-machine direction) such that the two marked lines appear within the coupon. Then load the coupon on a tensile tester, using the two marked lines to ensure that the grips in the tester are 6 inches apart. The coupon therefore is held in the grips such that the two lines end up 6 inches apart between the grips. The coupon is then stretched at a constant strain rate while stress and strain are simultaneously recorded for a number of different points, which are plotted on the curve shown below. The strain at yield is then recorded at the inflection point in the curve as shown in the figure below. This procedure is repeated thru-roll by performing the same test at different diameters within the wound roll.

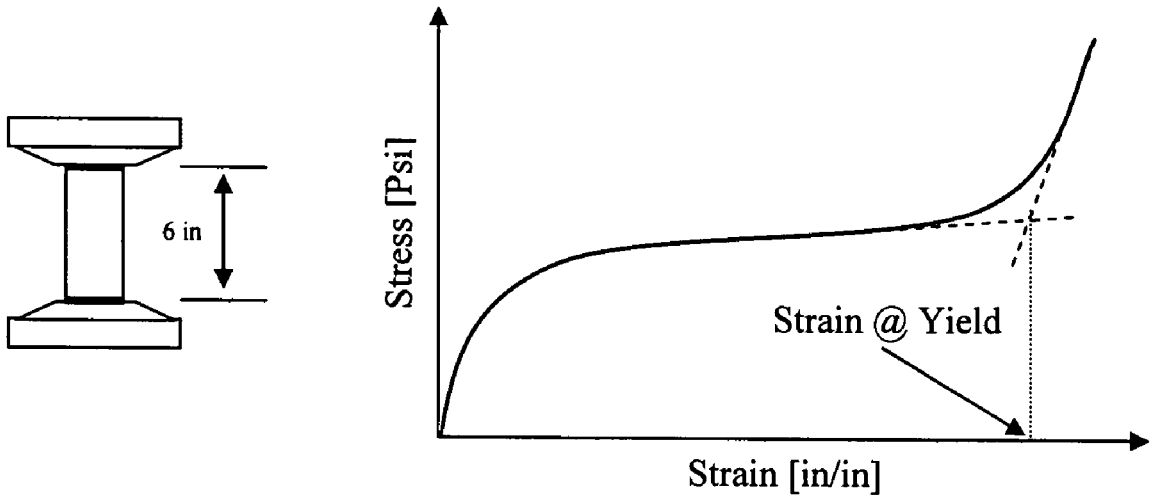
6 in
Stress [Psi]
Strain @ Yield
Strain [in/in]

Also, the thru-roll stored MD strain was actually measured. The "MD strain" is determined in a manner similar to what is described above, except that in the case of MD strain, the coupon is observed for the amount of shrink. Coupons of same length were cut from the web at different diameters thru-roll and observed for the amount of shrink. Based on the shrink, the stored MD strain can be calculated as the ratio of the difference in length to the original coupon length.

MD Strain

The step-by-step procedure for measuring the "MD strain" parameter presented in the Figs. herein can be summarized as follows: Mark two lines 6 inches apart along the circumference of the roll at the outer diameter. Then cut a coupon that is 8 inches long by 3 inches wide such that the marked lines appear within the coupon. Place the coupon on a flat surface, and measure the retracted length (the distance between the two marked lines) immediately. The MD strain that is stored in the roll is then calculated as the ratio of the difference between original length and the retracted length to the original length and is expressed as a percentage (%) of the original length. This procedure is repeated thru-roll by performing the same test at different diameters within the wound roll.

Figure 9:
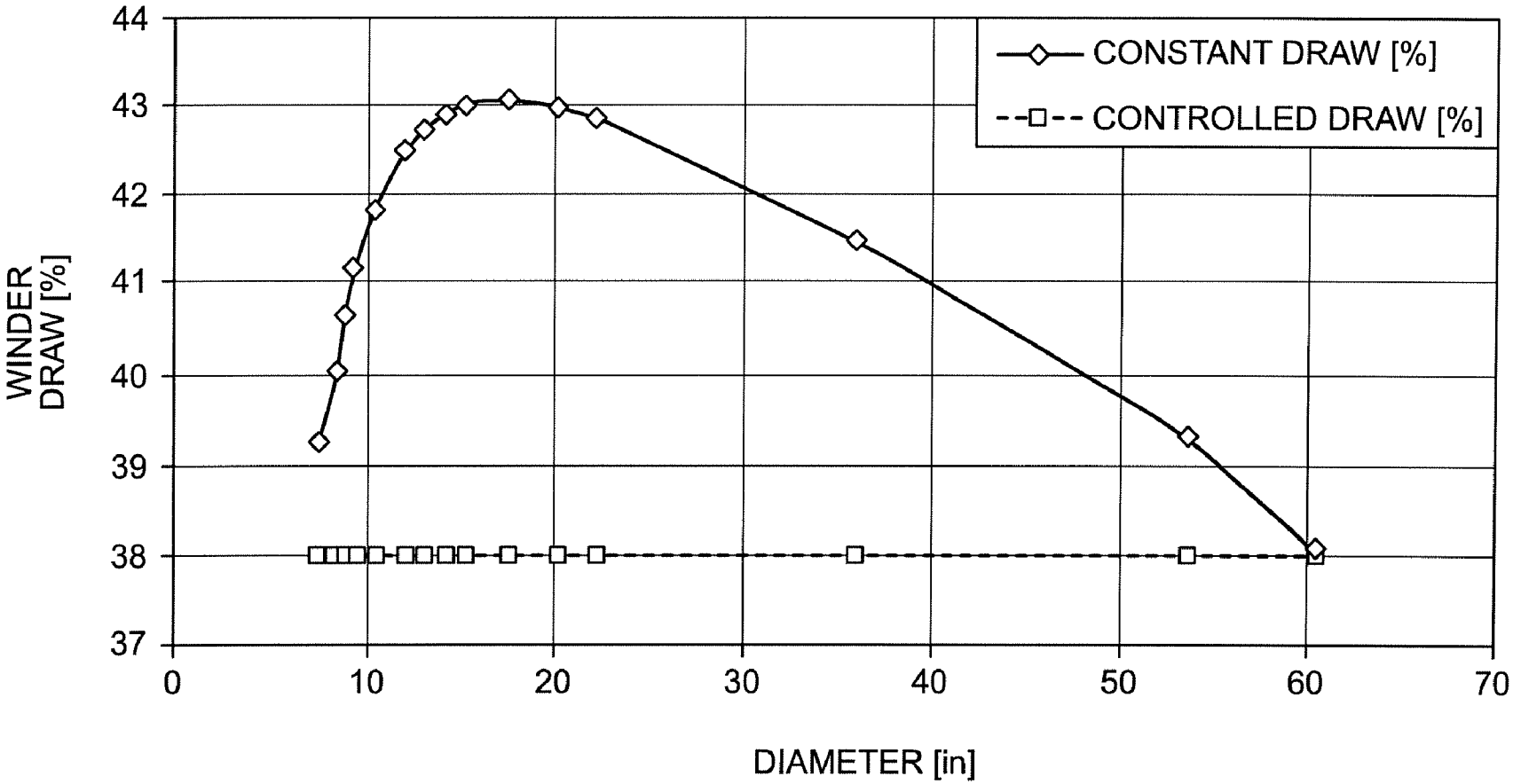
FIG. 9 graphically presents a comparison between the winder draws for a roll wound using a controlled WOT profile (depending on the diameter being wound on the roll, e.g., as in FIG. 6) designed to produce uniform MD stress within the roll (lower curve) and a roll wound using a constant WOT (as in FIG. 2) regardless of the diameter being wound on the roll (upper curve).

The draw profile is shown in FIG. 9, and the results in terms of the MD strain in each of the webs are shown in FIG. 10*a*. Note that each data point in each of FIGS. 10*a-e* and 11*a-e* represents an average of three individual measurements, and the variability in the data can be expressed using a parameter called Coefficient of variance, which is explained as follows $$\% \ Cv = \frac{SD}{\text{Mean}} \times 100$$

where % Cv is the Coefficient of variance and SD is the Standard Deviation. Thus, the larger the value of % Cv, the greater the variability in the data.

The draw profile shown in FIG. 9 was obtained by converting the stress to draw values based on a relation established between draw and tension as described in the preceding section. Thus, as shown in FIG. 9 for a roll of a first VFL material, the winder draw changes from about 39% when winding the web around the core of the roll up to about 43% when winding the web at about the middle of the wound roll, and then back down to about 38% when winding the web at the outside diameter of the wound roll in a relatively smooth controlled fashion dictated by the data points generated from the winder computer program. Observe that the uniformity is measured in terms of strain.

As predicted, and shown by the plot of square data points in FIG. 10*a*, the roll that was wound using the controlled WOT has a relatively constant MD strain at each diameter within the roll. As shown by the line plotting the diamond data points in FIG. 10*a*, the roll that was wound using the constant WOT for the same first VFL material has a widely varying MD strain depending on where in the roll the measurement is taken for the web wound on the roll. This wider variation in the roll that was wound using the constant WOT for the same first VFL material is confirmed for the alternative measurements of strain at yield as a function of the diameter of the roll shown in FIG. 10*b*. Moreover, as shown in FIGS. 10*c* and 10*d*, the wider variation of the respective MD strain measurements and strain at yield measurements (the diamond data points) becomes even more evident when the measurements are plotted as a function of the distance along the length of the roll from the end of the roll at the core to the free end of the material.

As noted in FIG. 10*a*, the MD strain measurements for the roll wound at constant WOT exhibit a 15.5 percent deviation around the mean, while the MD strain measurements for the roll wound at the controlled WOT exhibit only a 5.6 percent deviation around the mean, which is about 64% (1−5.6/15.5) greater uniformity for the same web material when wound at the controlled WOT in accordance with the present disclosure. This same result of substantial uniformity throughout the roll also obtains as shown in FIG. 10*b* for the strain at yield data (square data points) that is plotted as a function of the diametral position in the roll for this same first VFL material. Moreover, as shown in FIGS. 10*c* and 10*d*, the substantial uniformity of the respective MD strain measurements and strain at yield measurements (the square data points) becomes even more evident when the measurements are plotted as a function of the distance along the length of the roll from the end of the roll at the core to the free end of the material. As shown in FIGS. 10*a* (64%), 10*b* (49%), 10*c* (64%) and 10*d* (49%), there is at least about a 50% improvement in uniformity in each case.

FIGS. 11*a*, 11*b*, 11*c*, and 11*d* graphically present various comparisons between the measured properties for a web of a second VFL material when would at constant WOT and at the controlled WOT prescribed by the present disclosure. As can be seen by comparing the relatively lower strain at yield data in FIG. 11*b* to the data in FIG. 10*b*, the second VFL material is less giving than the first VFL material. And yet the degree of uniformity is always far higher for the roll that is wound at the controlled WOT in accordance with the present disclosure.

FIG. 11*b* for example permits a graphical comparison of the measured MD strain at yield (the square data points) for a roll wound using a controlled WOT profile (depending on the diameter being wound on the roll, e.g., as in FIG. 6) and the measured MD strain at yield for the web (the diamond data points) within a roll (upper curve) wound using a constant WOT (as in FIG. 2) regardless of the diameter being wound on the roll. As predicted, and shown by the plotted square data points in FIG. 11*b*, the roll that was wound using the controlled WOT has a relatively constant MD strain at yield measurement at each diameter within the roll of the second VFL material. As shown by the plotted square data points in FIG. 11*b*, the roll that was wound using the constant WOT has a widely varying MD strain at yield measurement depending on where in the roll the measurement is taken for the web of the second VFL material wound on the roll. This wider variation in the roll that was wound using the constant WOT for the same first VFL material is confirmed for the alternative measurements of MD strain as a function of the diameter of the roll shown in FIG. 11*a*. Moreover, as shown in FIGS. 11*c* and 11*d*, the wider variation of the respective MD strain measurements and strain at yield measurements (the diamond data points) becomes even more evident when the measurements are plotted as a function of the distance along the length of the roll from the end of the roll at the core to the free end of the material.

As noted in FIG. 11*a*, the MD strain measurements for the roll of the second VFL material wound at constant WOT exhibit a 13.9 percent deviation around the mean, while the MD strain measurements for the roll wound at the controlled WOT exhibit only a 4 percent deviation around the mean, which is about 71% (1−4/13.9) greater uniformity for the same web material when wound at the controlled WOT in accordance with the present disclosure. This same result of substantial uniformity throughout the roll also obtains as shown in FIG. 11*b* for the strain at yield data (square data points) that is plotted as a function of the diametral position in the roll for this same second VFL material. Moreover, as shown in FIGS. 11*c* and 11*d*, the substantial uniformity of the respective MD strain measurements and strain at yield measurements (the square data points) becomes even more evident when the measurements are plotted as a function of the distance along the length of the roll from the end of the roll at the core to the free end of the material. As shown in FIGS. 11*a* (71%), 11*b* (59%), 11*c* (71%) and 11*d* (59%), there is at least about a 50% improvement in uniformity in each case.

As is apparent from the data presented in FIGS. 10*a*, 10*b*, 10*c*, 10*d*, 11*a*, 11*b*, 11*c* and 11*d*, the thru-roll variability of the MD tension of the roll of web material wound according to the compensated WOT profile is reduced by about 40% to about 70% relative to thru-roll variability of the MD tension of a roll of the same web material and same diameter wound at constant WOT.

FIG. 12 schematically presents in the form of a flow chart, steps that can be taken to practice an embodiment of the method of the present disclosure that yields a roll of substantially constant MD stress after having been wound using a controlled WOT profile that varies the WOT depending on the diameter being wound on the roll (e.g., as in FIG. 6). The present method is particularly useful for extensible and/or elastic webs (e.g., films, strands, non-woven materials, and laminates of one or more of any of the foregoing) such as the MD elastomeric laminates disclosed in U.S. Pat. No. 5,385,775 to Wright, U.S. Patent Application Publication No. 2002/0104608 to Welch, et al., and U.S. Patent Application Publication No. 2005/0170729 to Stadelman, et al., each of which being incorporated herein in its entirety for all purposes by this reference thereto.

Materials that display the following behavior will benefit from the winding technique of the present disclosure:

- Any web material that has a Machine Direction Modulus that is close to the Radial Modulus or
- Any materials that have a "Nike®-Swoosh®" profile thru roll as measured by MD Stress or Strain or some other parallel measurement Typically, the following materials are among those that fall under the above categories: nonwovens, nonwoven laminates, machine direction (MD) oriented elastomerics (stretchy in the MD), MD elastomeric laminates, films, film laminates, and very high loft tissue where MD and ZD Modulus are close to the same value.

While at least one presently preferred embodiment of the present disclosure has been described using specific terms, such description is for illustrative purposes only, and it is to be understood that changes and variations may be made without departing from the spirit or scope of the following claims.

APPENDIX A

This computer program was written in Visual Basic Application code (VBA) within an Excel document.

APPENDIX A

This computer program was written in Visual Basic Application code (VBA) within an Excel document

```
Option Explicit
Sub Winding__Model__For__Uniform__Properties( )
  Dim Et As Double, Pr As Double
  Dim K1 As Double, K2 As Double
  Dim Ec As Double, NL As Integer
  Dim h As Double, Tw As Double
  Dim Rmin As Double, Rmax As Double
  Dim Rc As Double, Prc As Double
```

APPENDIX A-continued

This computer program was written in Visual Basic Application code (VBA) within an Excel document

```
  Dim i As Integer, layer As Integer
  Dim k As Integer, m As Double
  Et = Range("Emd"): Pr = Range("pnr")
  K1 = Range("kone"): K2 = Range("ktwo")
  h = Range("h"): Tw = Range("tw"): NL = Range("nl")
  Rmin = Range("COD") / 2: Rmax = Range("WOD") / 2
  Rc = Range("CID") / 2: Prc = Range("pnrcore")
  Ec = Range("ec") * ((Rmin ^ 2 - Rc ^ 2) / (Rmin ^ 2 +
Rc ^ 2 - Prc * (Rmin ^ 2 - Rc ^ 2)))
  ReDim Rp(NL + 1) As Double, Ts(NL + 1) As Double
  ReDim r(NL + 1) As Double, Er(NL + 1) As Double
  ReDim dp(NL + 1) As Double, dt(NL + 1) As Double
  ReDim a(NL + 1) As Double, b(NL + 1) As Double
  ReDim c(NL + 1) As Double, d(NL + 1) As Double
  ReDim bd(NL + 1) As Double, dd(NL + 1) As Double
  ReDim Twc(NL + 1) As Double
  Range("E5:M20000").Select
  Selection.ClearContents
  Range("E5").Select
  With Application
    .Calculation = xlCalculationAutomatic
  End With
  For i = 1 To NL + 1
    Rp(i) = 0: Ts(i) = 0: r(i) = 0: Er(i) = 0
    dp(i) = 0: dt(i) = 0: a(i) = 0: b(i) = 0
    c(i) = 0: d(i) = 0: bd(i) = 0: dd(i) = 0
  Next i
  For i = 1 To NL + 1
    r(i) = Rmin + (i - 1) * h
  Next i
  'Radial Pressure of layer 1
  dp(1) = Tw / r(1) * h
  Rp(1) = Rp(1) + dp(1)
  Er(1) = K2 * (K1 + Rp(1))
  dt(1) = Tw
  Ts(1) = Ts(1) + dt(1)
  'Radial pressure of layer 2 and 1
  dp(2) = Tw / r(2) * h
  Rp(2) = dp(2)
  Er(2) = K2 * (K1 + Rp(2))
  dt(2) = Tw
  Ts(2) = Ts(2) + dt(2)
  dp(1) = (dp(2) * r(1) / h) / (Et / Ec - 1 + Pr + r(1) / h)
  Rp(1) = Rp(1) + dp(1)
  Er(1) = K2 * (K1 + Rp(1))
  dt(1) = -dp(1) * (Et / Ec + Pr)
  Ts(1) = Ts(1) + dt(1)
  For layer = 3 To NL + 1
    Range("A24") = "Performing Constant WOT Calculations"
    'set up tridiagonal matrix
    a(layer) = 0: b(layer) = 1
    c(layer) = 0: d(layer) = Tw * h / r(layer)
    For i = 2 To layer - 1
      a(i) = 1 + (3 * h) / (2 * r(i))
      b(i) = (h ^ 2 / r(i) ^ 2) * (1 - Et / Er(i)) - 2
      c(i) = 1 - (3 * h) / (2 * r(i))
      d(i) = 0
    Next i
    a(1) = 1: b(1) = -(Et / Ec - 1 + Pr + r(1) / h) * h / r(1)
    c(1) = 0: d(1) = 0
    'solve tridiagonal matrix using Thomas algorithm
    'Forward elimination
    bd(1) = b(1): dd(1) = 0
    For k = 2 To layer
      m = c(k) / bd(k - 1)
      bd(k) = b(k) - m * a(k - 1)
      dd(k) = d(k) - m * dd(k - 1)
    Next k
    'Backward Substitution
    dp(layer) = dd(layer) / bd(layer)
    For k = layer - 1 To 1 Step -1
      dp(k) = (dd(k) - a(k) * dp(k + 1)) / bd(k)
    Next k
    dt(1) = -dp(1) * (Et / Ec + Pr)
    dt(layer) = Tw
    For k = 2 To layer - 1
      dt(k) = -dp(k) - r(k) * (dp(k + 1) - dp(k - 1)) / (2 * h)
```

APPENDIX A-continued

This computer program was written in Visual Basic Application code (VBA) within an Excel document

```
    Next k
    For k = 1 To layer
        Rp(k) = Rp(k) + dp(k)
        Er(k) = K2 * (K1 + Rp(k))
        Ts(k) = Ts(k) + dt(k)
    Next k
    If layer / 10 = Int(layer / 10) Then
        Range("B23") = layer
    End If
Next layer
For i = 1 To NL + 1
    Cells(i + 4, 5) = 2 * r(i)
    Cells(i + 4, 6) = Tw
    Cells(i + 4, 7) = Rp(i)
    Cells(i + 4, 8) = Ts(i)
Next i
For i = 1 To NL + 1
    Twc(i) = Tw + Tw - Ts(i)
Next i
'Calculation for uniform properties begins in the following lines
For i = 1 To NL + 1
    Rp(i) = 0: Ts(i) = 0: r(i) = 0: Er(i) = 0
    dp(i) = 0: dt(i) = 0: a(i) = 0: b(i) = 0
    c(i) = 0: d(i) = 0: bd(i) = 0: dd(i) = 0
Next i
For i = 1 To NL + 1
    r(i) = Rmin + (i - 1) * h
Next i
'Radial Pressure of layer 1
dp(1) = Twc(1) / r(1) * h
Rp(1) = Rp(1) + dp(1)
Er(1) = K2 * (K1 + Rp(1))
dt(1) = Tw
Ts(1) = Ts(1) + dt(1)
'Radial pressure of layer 2 and 1
dp(2) = Twc(2) / r(2) * h
Rp(2) = dp(2)
Er(2) = K2 * (K1 + Rp(2))
dt(2) = Twc(2)
Ts(2) = Ts(2) + dt(2)
dp(1) = (dp(2) * r(1) / h) / (Et / Ec - 1 + Pr + r(1) / h)
Rp(1) = Rp(1) + dp(1)
Er(1) = K2 * (K1 + Rp(1))
dt(1) = -dp(1) * (Et / Ec + Pr)
Ts(1) = Ts(1) + dt(1)
For layer = 3 To NL + 1
    Range("A24") = "Performing Controlled WOT Calculations"
    'set up tridiagonal matrix
    a(layer) = 0: b(layer) = 1
    c(layer) = 0: d(layer) = Twc(layer) * h / r(layer)
    For i = 2 To layer - 1
        a(i) = 1 + (3 * h) / (2 * r(i))
        b(i) = (h ^ 2 / r(i) ^ 2) * (1 - Et / Er(i)) - 2
        c(i) = 1 - (3 * h) / (2 * r(i))
        d(i) = 0
    Next i
    a(1) = 1: b(1) = -(Et / Ec - 1 + Pr + r(1) / h) * h / r(1)
    c(1) = 0: d(1) = 0
    'solve tridiagonal matrix using Thomas algorithm
    'Forward elimination
    bd(1) = b(1): dd(1) = 0
    For k = 2 To layer
        m = c(k) / bd(k - 1)
        bd(k) = b(k) - m * a(k - 1)
        dd(k) = d(k) - m * dd(k - 1)
    Next k
    'Backward Substitution
    dp(layer) = dd(layer) / bd(layer)
    For k = layer - 1 To 1 Step -1
        dp(k) = (dd(k) - a(k) * dp(k + 1)) / bd(k)
    Next k
    dt(1) = -dp(1) * (Et / Ec + Pr)
    dt(layer) = Twc(layer)
    For k = 2 To layer - 1
        dt(k) = -dp(k) - r(k) * (dp(k + 1) - dp(k - 1)) / (2 * h)
    Next k
    For k = 1 To layer
        Rp(k) = Rp(k) + dp(k)
        Er(k) = K2 * (K1 + Rp(k))
        Ts(k) = Ts(k) + dt(k)
    Next k
    If layer / 10 = Int(layer / 10) Then
        Range("B23") = layer
    End If
Next layer
Ts(1) = Ts(2)
For i = 1 To NL + 1
    Cells(i + 4, 9) = Twc(i)
    Cells(i + 4, 10) = Rp(i)
    Cells(i + 4, 11) = Ts(i)
    Cells(i + 4, 12) = Tw * 0.1 + 100
    Cells(i + 4, 13) = Twc(i) * 0.1 + 100
Next i
Range("A24") = "Finished Calculations"
End Sub
```

What is claimed is:

1. A method for winding a continuous web material having a machine direction (MD) modulus that is approximately equal to the radial modulus of the web material to form a compressed roll of the wound web material so that the machine direction (MD) strain is substantially uniform throughout the wound roll of web material, the method comprising winding the web material onto the roll so that the outermost layer of web material is wound onto the roll in accordance with a predetermined wound on tension (WOT) profile that varies with the diameter and is calculated based on WOT transposition;

wherein using WOT transposition to calculate a WOT profile that varies with the diameter of the wound web, includes: assuming a constant WOT in the web material as the web material is being wound onto the roll and further assuming that the initial MD tension condition are those conditions of MD tension in the web material when it has been completely wound on the roll, using a computer model to determine the initial MD tension conditions within a wound roll of the continuous web material as a function of the wound roll diameter, based on the conditions generated from the computer model, using the computer model to generate a compensated WOT profile, wherein the compensated WOT profile varies as a function of the wound roll diameter and wherein the compensated WOT profile is the WOT that is needed in the web as the web is being wound onto the roll in order to provide the wound roll with a uniform thru-roll MD tension.

2. The method of claim 1, wherein control system software controls the winder in a draw control mode as a function of the compensated WOT profile.

3. The method of claim 2, wherein the compensated WOT profile is converted to a draw control profile based on a known relation between winder draw and the WOT in the web that is being wound.

4. The method of claim 1, further comprising using a programmable logic controller (PLC) to control the winder as a function of the compensated WOT profile in a tension control mode.

5. The method of claim 4, wherein a load cell is used to directly monitor WOT tension and the information monitored by the load cell is provided to the PLC during the winding of the web material onto the roll.

6. The method of claim 1, wherein the compensated WOT profile is converted to speed control based on a predetermined relation between winder speed and WOT for the web.

7. The method of claim 6, wherein a control system controls winder speed as a function of wound roll diameter.

8. The method of claim 7, wherein control system software is used to control the winder speed as a function of wound roll diameter by using a set of discrete points from the compensated WOT profile and interpolating between these points to accomplish the desired change in winder draw as a function of roll diameter.

9. The method of claim 8, wherein the winder is driven by an electric winder motor, the winder speed can be varied as a function of the electric current supplied to the winder motor and control system software is used to control the winder motor current as a function of wound roll diameter by using a set of discrete points from the compensated WOT profile and interpolating between these points to accomplish the desired change in draw as a function of roll diameter.

10. The method of claim 1, wherein control system software controls the winder in a nip control mode as a function of the compensated WOT profile.

11. The method of claim 1, wherein the computer model is based on Hakiel's nonlinear model for wound roll stresses.

12. The method of claim 11, wherein the compensated WOT profile resembles the shape of a Type 1 combined exponential and power function curve $y=a X^b c^x$ where $a>0$, $b=2$, $c=0.5$ and $x\epsilon[0,10]$.

13. The method of claim 1, further comprising correlating between a controllable parameter of the winder and the WOT of the web being wound by the winder onto the roll of web material.

14. The method of claim 13, wherein for each of a predetermined number of selected data points, the computer model generates a predicted compensated WOT value for achieving substantially uniform thru-roll MD tension in the wound roll and wherein the compensated WOT value and the correlation is used by PLC software to control the winder to achieve substantially uniform thru-roll MD tension in the wound roll.

15. The method of claim 1, wherein the web material is composed of at least one of the following: nonwovens, nonwoven laminates, machine direction oriented elastomerics, machine direction elastomeric laminates, films, film laminates, and very high loft tissue.

16. The method of claim 1, wherein the web material is a vertical film/filament laminate (VFL) material.

17. The method of claim 1, wherein the MD strain has a coefficient of variance of less than 13.9% throughout the wound roll of web material.

18. The method of claim 1, wherein the MD strain has a coefficient of variance of about 5.6% or less throughout the wound roll of web material.

19. The method of claim 1, wherein the MD strain of the wound roll is reduced by 40% to 70% relative to the MD strain of a roll of the same material and same diameter wound at constant WOT.

20. The method of claim 1, wherein the thru-roll MD stress is substantially constant over 98% or more of the entire web length measured from the outside diameter of the wound roll inwardly toward the core of the wound roll.

21. A roll of web material wound according to the method of claim 1.

22. The roll of claim 21, wherein the web material is a vertical film/filament laminate (VFL) material.

* * * * *